US005899030A

United States Patent [19]

Barefield

[11] Patent Number: 5,899,030

[45] **Date of Patent: * May 4, 1999**

[54] POST ANCHOR AND METHOD OF INSTALLING A POST

[76] Inventor: David H Barefield, 1605 Palm Dr., Avon Park, Fla. 33825

[ * ] Notice: This patent is subject to a terminal disclaimer.

[21] Appl. No.: 08/916,068

[22] Filed: Aug. 21, 1997

Related U.S. Application Data

[63] Continuation-in-part of application No. 08/631,971, Apr. 15, 1996, Pat. No. 5,661,932.

[51] Int. Cl.[6] ..... E02D 5/80

[52] U.S. Cl. ..... 52/154; 52/155; 52/156; 52/158; 52/166; 403/374

[58] Field of Search ..... 52/154, 155, 156, 52/158, 159, 165, 166; 403/374, 371

[56] References Cited

U.S. PATENT DOCUMENTS

| | | | |
|---|---|---|---|
| 373,240 | 11/1887 | Logan | 52/154 |
| 1,599,745 | 9/1926 | Cinnamond | 52/155 |
| 3,342,444 | 9/1967 | Nelson | 52/154 |
| 4,882,891 | 11/1989 | Sero et al. | 52/154 X |
| 5,661,932 | 9/1997 | Barefield | 52/154 |

*Primary Examiner*—Carl D. Friedman
*Assistant Examiner*—W. Glenn Edwards

[57] ABSTRACT

The disclosure relates to the use of a post anchor adaptable to impact insertion into the earthen ground to rigidly support a post extending above ground level. The post anchor is functional without requiring the use of concrete to reinforce the post anchor within the earthen ground. A driveable member and a locking member cooperate to form each post anchor. The driveable member must be formed from at least one piece of a sheet material. The sheet material is subjected to a deforming process to render definable unique panels thereon definable from adjacent panels by a linear juncture. A post engaging channel cooperates with a plurality of ground engaging fins to provide displacement resistance properties to the post anchor. A secure attachment, using the locking member, occurs to secure the post to the driveable member following placement of both the post and the driveable member during the installation procedure. Either a single sheet piece or multiple sheet pieces form the driveable member. The post anchor permits repositioning of the post relative to the driveable member following installation. A sub-grade surface may be incorporated into the post anchor above the ground engaging fins, while permitting passage of the post engaging channel therethrough, to enhance the function of the post anchor.

20 Claims, 13 Drawing Sheets

FIG. 27
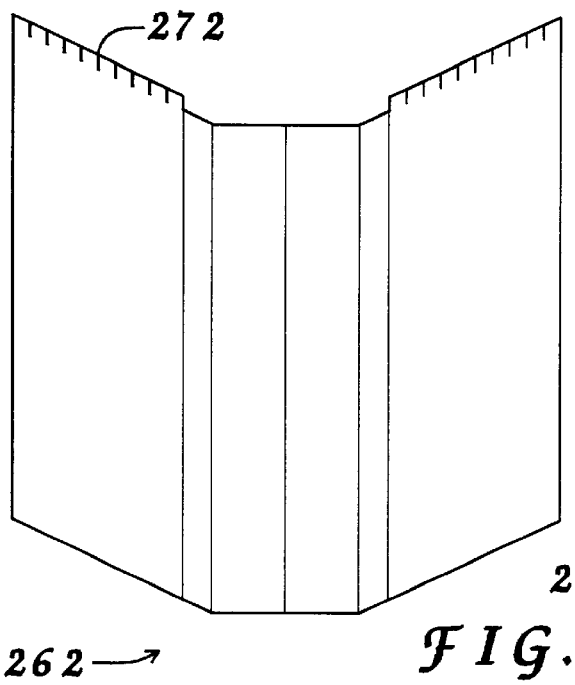
FIG. 28
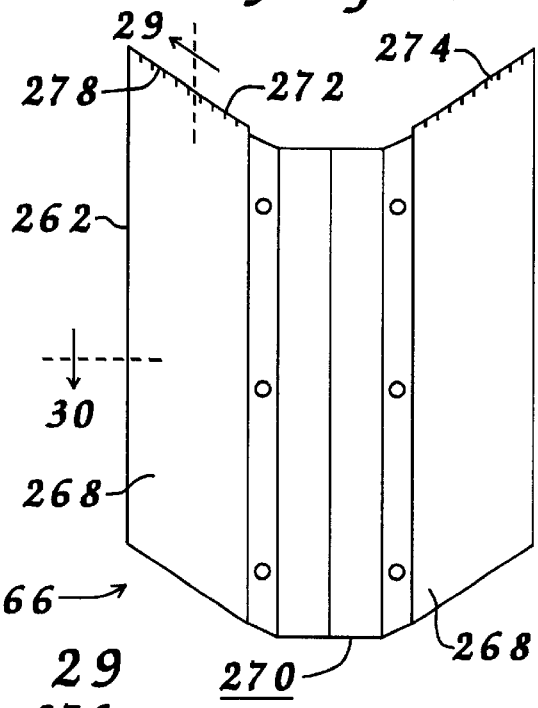
FIG. 29
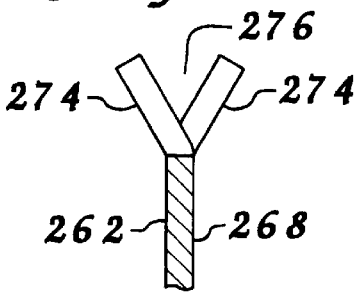
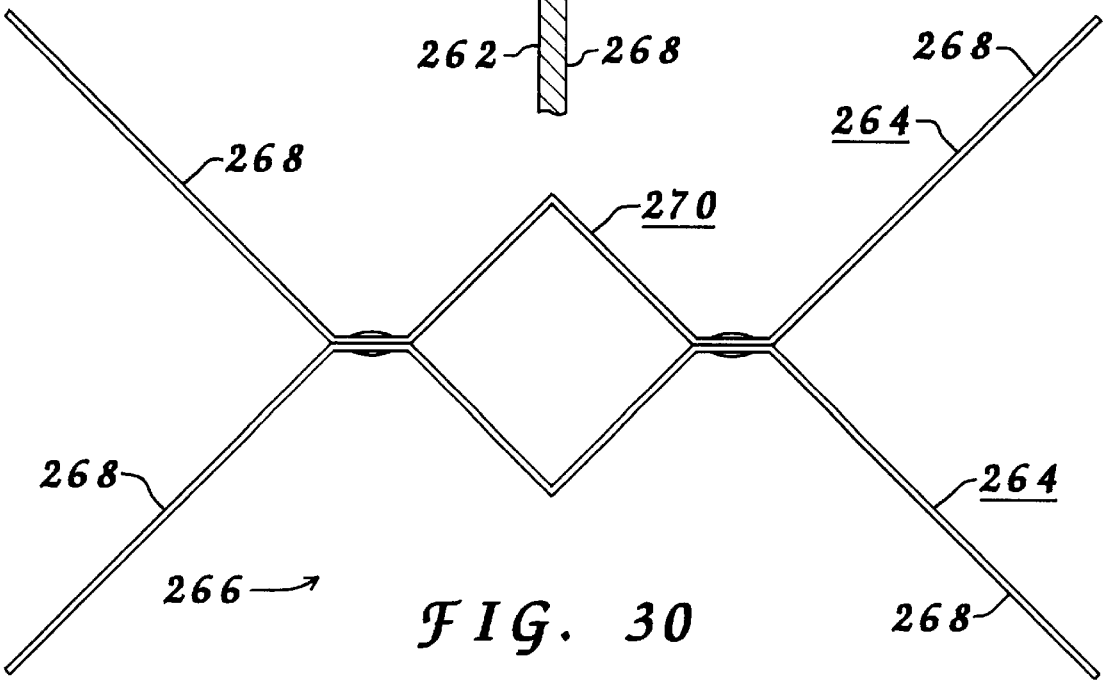
FIG. 30

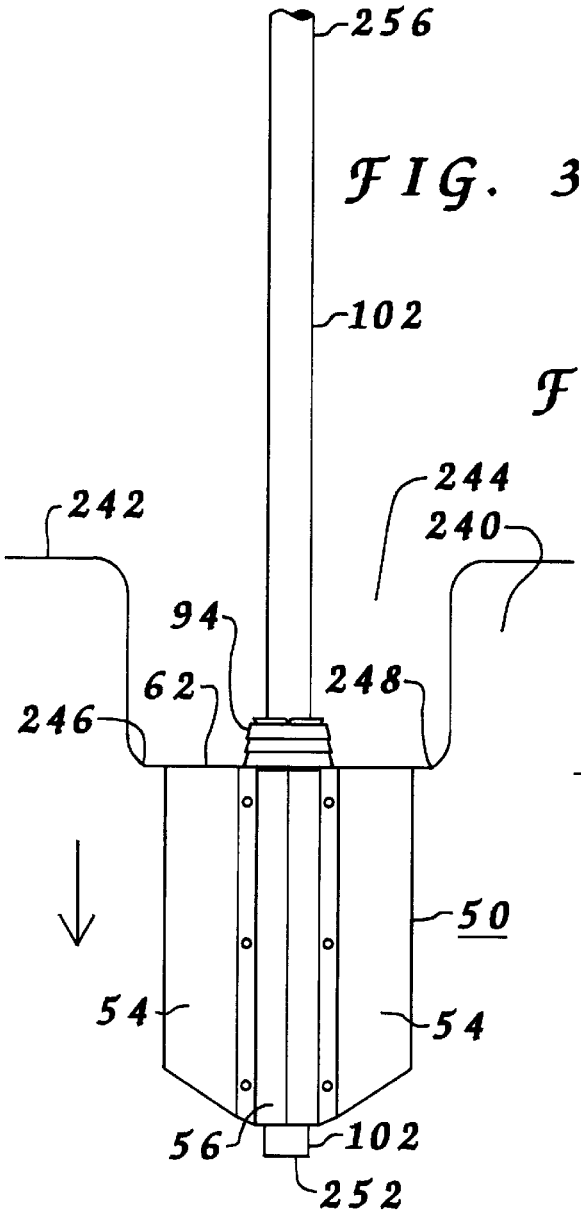
FIG. 39
FIG. 40
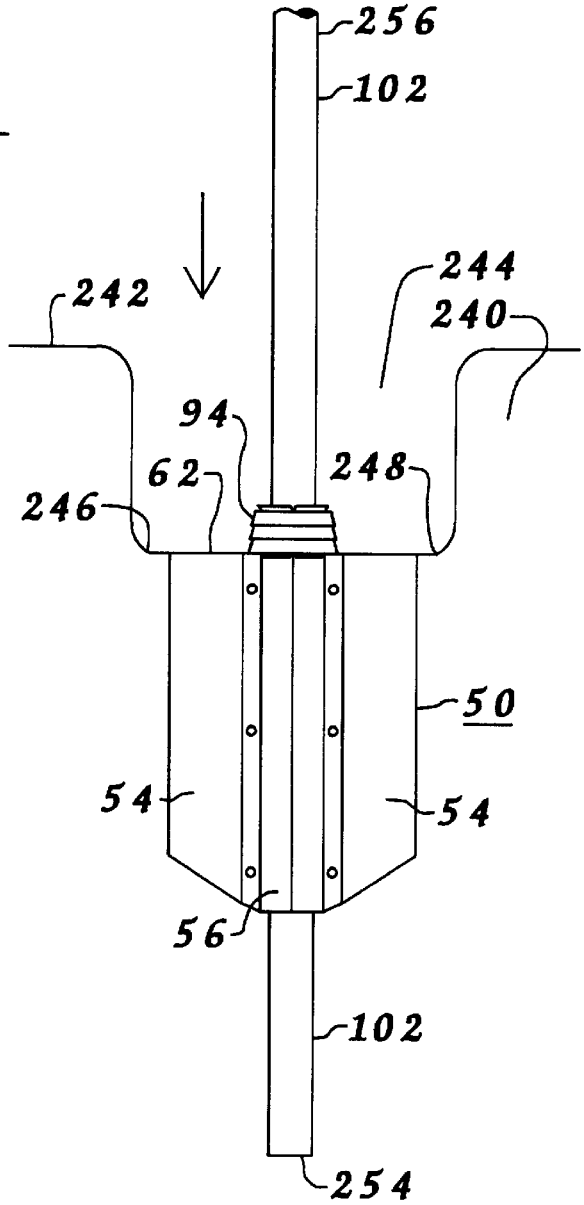

FIG. 45
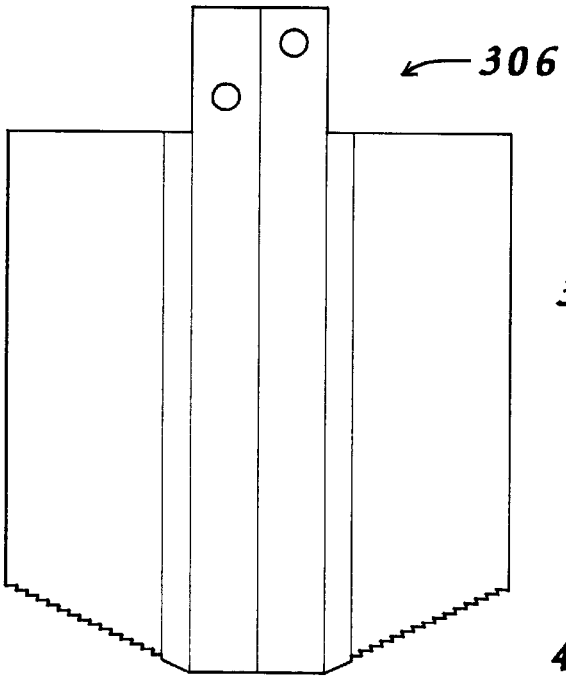
FIG. 46
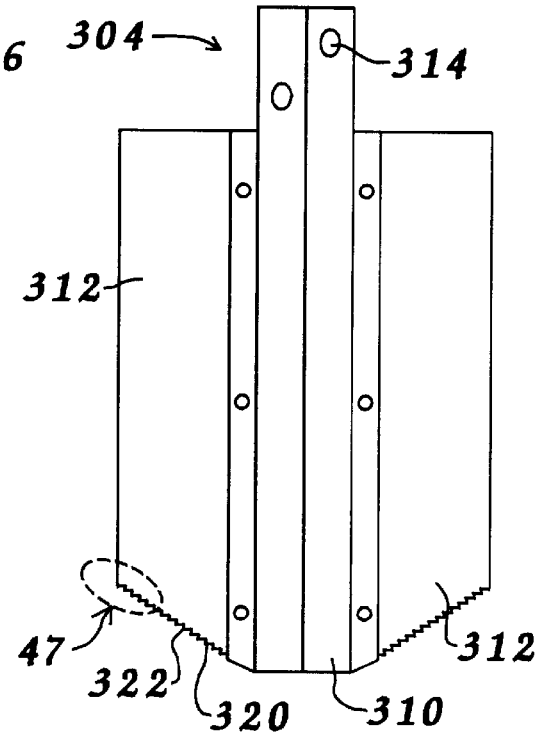
FIG. 47
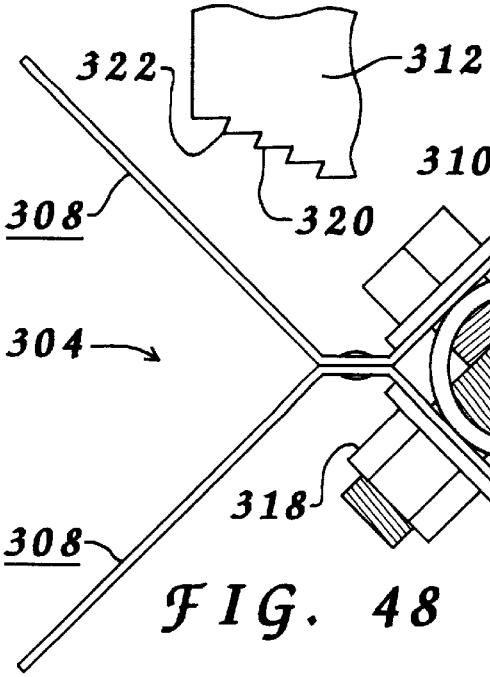
FIG. 49
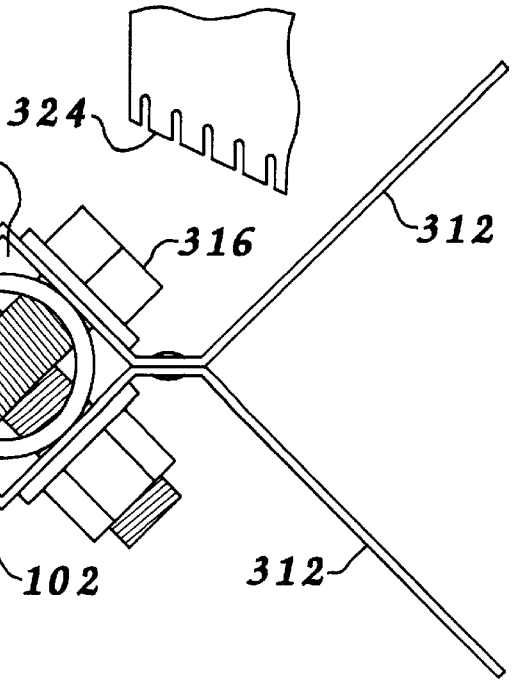
FIG. 48

POST ANCHOR AND METHOD OF INSTALLING A POST

CROSS-REFERENCE

The present application is a continuation-in-part application of my U.S. Ser. No. 08/631,971 filed Apr. 15, 1996, entitled "Post Anchor and Method of Installing a Post", now U.S. Pat. No. 5,661,932. This application is incorporated herein by this reference.

BACKGROUND

1. Field of the Invention

Generally, the invention relates to anchoring posts in the earthen ground. More specifically, the invention relates to sheet material formed post anchors which are driveable and adaptable for deployment without requiring the use of concrete.

2. Description of the Prior Art

The anchoring of posts in the earthen ground satisfies various needs. The attachment of signs to the post, as exampled by signs posted in yard advertising the availability of the property for sale, is one common example. Similarly, the attachment of signs to posts along roads advise motorists of various conditions or that various provisions of laws are in effect for that specific stretch of road. Common examples of these type of signs include 'stop' signs and signs notifying motorists of the 'posted' speed limits in effect.

Turning now to posts which support structural entities rather than signs, the most common structure supporting use of posts is to support fencing. In this usage, a configuration of a plurality of posts cooperate to provide for an aligned arrangement, most often linear. A common usage involves various linear sections which cooperate to define a perimeter which surrounds and encloses an area.

In the agricultural area, posts enclose areas with barbed wire or a heavy gauge wire mesh fencing spanning and attached to each post in succession. This usage provides for the containment or exclusion of animals.

In the residential area, posts enclose areas with chain link, boarding or some other suitable material spanning and attached to each post in succession. This usage commonly defines a section of the boundaries of the subject property, as exampled by enclosing the backyard of a home. This usage is extremely common due to the desire of people to restrict ingress and egress from their property.

The most common method in current use of anchoring a post into the earthen ground comprises the following steps. Digging of a deep narrow hole into the ground occurs. Following forming of this hole, insertion of a post into the hole occurs. Then the placement of concrete to radially surround the post occurs to at least partially fill the hole. Following the setting of this concrete, generally the following day, installation of the fencing material occurs to span a plurality of such installed posts and define the fence.

Several disadvantages exist with this method which make the method less efficient than desired. Sandy soil conditions tend to expand the upper extent of the hole beyond the desired size. There is a requirement of special motorized digging equipment which eliminates the requirement of manually scooping out the dirt with post hole diggers. The labor expense involved with the digging of the holes, using either method, is significant. The requirement of mixing concrete at the job site is time consuming, expensive and messy. There is a strong likelihood that even a simple job may span multiple days due to the strong desire that the concrete harden about the post prior to attachment of the fencing material to the post.

Various attempts have been made to provide a structural device capable of placement into the earthen ground for attachment thereto of a post. These devices attempt to provide various large surface areas distributed in the ground to cooperate to act to resist motion of the device while in the earthen ground.

Generally, acceptance in the industry of these devices is lacking. They are difficult to install. They lack sufficient resistance properties once installed to acceptably resist motion of the post above the ground. They are prohibitively expensive when compared to the conventional dig and concrete method. These devices also lack the versatility to permit the elevation of the post to be easily adjusted relative to the fixed anchor device following installation.

For these reasons there remains a need for a simple anchor device which is adaptable for installation into the earthen ground with minimal labor consumption, which provide for acceptable motion resistance within the earthen ground following installation and which also permit repositioning of the elevation of the post relative to the fixed anchor device without requiring repositioning of the anchor device within the ground. The present invention substantially fulfills these needs.

SUMMARY

In view of the foregoing disadvantages inherent in the conventional method of securing post in the earthen ground, your applicant has devised a driveable post anchor to overcome those disadvantages. The driveable post anchors applicable to the instant invention have several features in common. Each post anchor is comprised of a driveable member and a locking member. The driveable member must be formed from at least one piece of a sheet material and have been subjected to a deforming process. The driveable member must present a vertical linear alignment permitting ready impact generated insertion into the earthen ground. The driveable member must have a post engaging channel to slideably receive the post. The driveable member must have sufficient vertically oriented surface areas, in the form of ground engaging fins, to restrict lateral displacement within the earthen ground following installation. These ground engaging fins must surround the post engaging channel. The locking member must be accessible at an upper extent of the post engaging channel following insertion of the driveable member into the earthen ground. The locking member must provide for attachment of the post, within the post engaging channel, at a desired elevational height relative to the driveable member.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The primary object of the present invention is to provide for a post anchor which will anchor a post in the earthen ground.

Other objects include;

a) to provide for a driveable member, being part of the post anchor, to be formed from at least one piece of a sheet material.

b) to provide for installation of the driveable member with a minimal of effort.

c) to provide for immediate usage of the post anchor following installation without requiring passage of a setting time interval.

d) to provide for impact force generated insertion of the driveable member into the earthen ground.

e) to provide for large vertically oriented surface areas distributed within the earthen ground to resist movement of the post anchor, and therefore the post, following installation.

f) to provide for the various features of the post anchor to cooperate to provide resistance to vertical motion of the extending attached post.

g) to provide for an optional sub-grade surface to restrict displacement of earthen ground over the large vertically oriented surface areas to enhance the resistance properties of the vertically oriented surface areas.

h) to provide for the driveable member to slideably receive the post, within a post engaging channel, to permit movement of the post and the driveable member relative to one another during the installation process.

i) to provide for securing the post within the post engaging channel to lock the post at a desired elevational position relative to the driveable member of the post anchor.

j) to provide for at least one sheet piece cut and bent, stamped or pressed and having only planar surfaces, to permit assembly to form the driveable member of a post anchor having the required features of the invention.

k) to provide for at least two sheet pieces cut and bent, stamped or pressed and having only planar surfaces, to permit attachment together and assembly to form the driveable member of the post anchor having the required features of the invention.

l) to provide for at least one sheet piece cut and stamped or pressed and having curved and planar surfaces thereon, to permit assembly to form the driveable member of the post anchor having the required features of the invention.

m) to provide for at least two sheet pieces cut and stamped or pressed and having curved and planar surfaces thereon, to permit attachment together and assembly to form the driveable member of the post anchor having the required features of the invention.

n) to provide for impact driven installation of the driveable member of the post anchor into the earthen ground using a partially driven post as a guide.

o) to provide for the reuse of the driveable member of the post anchor following removal from the earthen ground.

p) to provide for the anchoring of posts in marshy areas where the ground is saturated with water and use of concrete is not possible or desirable.

q) to provide for anchoring posts having any cross section profile including round, oval, square or rectangular.

r) to provide for the readjustment of the elevational height of the post at any time following initial installation without requiring movement of the driveable member of the post anchor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 27 is an elevational view of another embodiment of a sheet material piece.

FIG. 28 is an elevational view of an anchor extension as formed by two (2), of the sheet material pieces shown in FIG. 27.

FIG. 29 is an enlarged section view as taken from the section line '29' shown in any FIG. 28.

FIG. 30 is an enlarged sectional view as taken from the section line '30' shown in FIG. 28.

FIG. 35 through FIG. 42 are elevational views depicting various portions of a method of installation.

FIG. 45 is an elevational view of another embodiment of a sheet material piece.

FIG. 46 is an elevational view of a post anchor formed from two (2) of the sheet material pieces shown in FIG. 45.

FIG. 47 is an enlarged sectional view as taken from the section line '47' shown in FIG. 46.

FIG. 48 is an overhead plan view of the post anchor shown in FIG. 46 with a post installed therein.

FIG. 49 is an elevational view of an alternative embodiment of teeth.

DESCRIPTION

Figure 1:
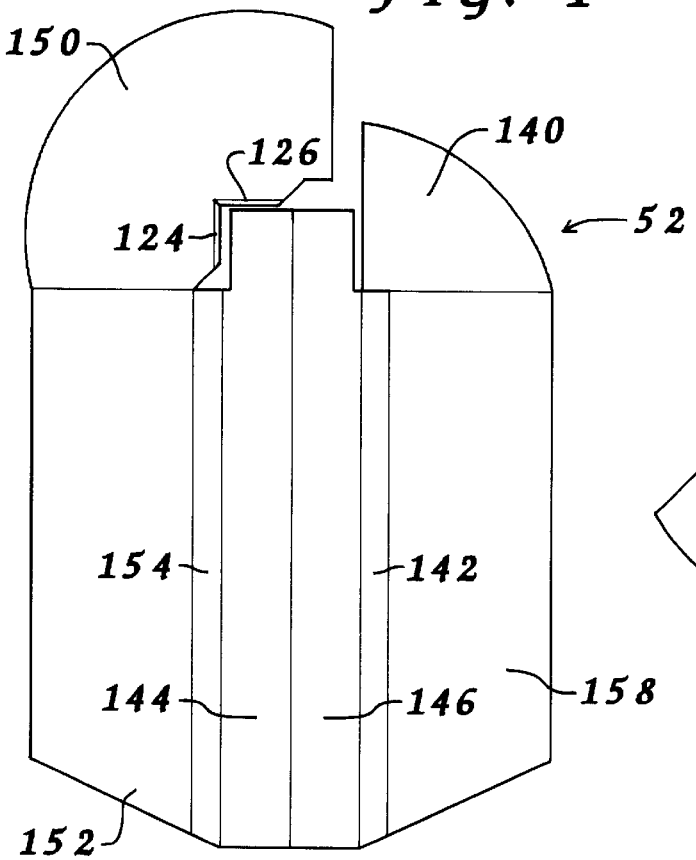
FIG. 1 is an elevational view of an embodiment of a sheet material piece.

Reference is now made to the drawings where like reference numerals refer to like parts throughout the various views.

1. Sheet Material Post Anchors

The term sheet material within sheet material post anchor is used when a driveable member, being part of the post anchor, is formed of sheet material deformed by either a stamping process or a bending process. Use of the term linear juncture defines the radical surface change between adjacent panels on the same piece of sheet material. These changes may be between two planar surfaces, a planar surface and a curved surface or between two curved surfaces.

The sheet material may be of any resilient planar composition, as exampled by a metal or a plastic. The composition of the sheet material may allow for a retention of the deformed shape following deformation. Alternatively, it may be a requirement that there be an exposure to a process to cause a retention of the deformed shape. Such a process is exampled by introduction of heat to a planar plastic sheet while held to the desired resultant shape.

Depending upon the deforming process, the composition of the sheet material and the outline pattern used, fastening connection between contacting panels may not be required. Generally, fastening connection will be required between contacting panels and numerous methods exist to bond the contacting panels together. These methods include using adhesives, overlapping clamping or crimping binding, thermally induced attachment and welding, including tack welding.

A single piece of sheet material may form the resultant driveable member. Preferably at least two pieces, and preferably two identical pieces to simplify the manufacturing process, of sheet material cooperate to form the driveable member. The disclosure which follows depicts examples having a single sheet and sets of two identical sheets. Use of additional sheet materials, identical or unique, are applicable without departing from the disclosure of the instant invention. One example of this would be to form the ground engaging fins and the post engaging channel of one sized set of identical pieces bent or stamped to the proper shape. Then, to form the sub-grade surface out of a separate unique piece, preferably with an aperture for penetration of the post engaging channel, as depicted within FIG. 13 through FIG. 17.

The disclosure which follows includes various sets each having two identical pieces of sheet material. One set examples performance of a bending process on a sheet material along fold lines to certain angles of offset. A pair of these bent sheet materials may then cooperate in combination to form the depicted driveable member. Identical results are obtainable by using a stamping process. The term 'stamping' as used herein includes a true stamping process wherein impact of one die occurs with a stationary surface while a sheet material resides therebetween as well as processes which are conventionally known as pressing, rolling or similar processes. Another set examples performance of a stamping process on a sheet material along stamping lines to certain angles of offset. These stamped units have curved surfaces thereon. A pair of these stamped sheet materials may then cooperate in combination to form the depicted driveable member. Yet another example depicts a deforming process, either bending or stamping, along fold lines to form a depicted driveable member from a single sheet material.

Preferably, any attachment connection between separate panels, either on one, (1), component or when attaching two, (2), components together, permits employment of tack welding for securement. This requires that the two, (2), attachment panels rest one on the other with the panel planes situated in parallel one to the other. The use of the term 'tack welding' herein is not intended to limit the material to metal, but rather extends to all materials which may be bound together through the application of heat. This usage includes the use of metal, plastic and other materials which may be so bound through the application of heat.

Each post anchor of the instant invention comprises a driveable member and a locking member. The driveable member must have a plurality of ground engaging fins and a post engaging channel. Additionally, it may have a sub-grade surface positioned proximate the upper edges of the ground engaging fins. The locking member, during and following attachment, must be accessible to the installer. A separate description of each of these features follows.

Posts applicable to the instant invention may have any cross section shape including round, oval, square or rectangular. The posts may be hollow or solid and construction may be of any suitable material such as wood, metal or plastic. In use, anchoring of the post into the earthen ground, with a post anchor secured to the post proximate the buried end of the post, occurs. The opposing end of the post, the upper post, remains exposed above the earthen ground. This exposed part of the post performs some desired function, depending upon the designated usage of the post. There are two directional possibilities for the application of pressure to the upper post. The first, and most common, is a horizontally applied pressure. The second, rarely applicable under normal conditions depending upon usage of the post, is a vertically applied pressure, either upward or downward. The disclosed post anchors have optional features which will satisfactorily resist downward pressure while satisfactorily resisting upward pressure. The primary function of the instant invention is to resist the application of horizontal pressure to the upper post exposed above the earthen ground.

During the application of significant horizontally directed pressure to the upper post, the post and the post anchor will attempt to move within the earthen ground. It is necessary to provide resistance to this movement in order to securely anchor the post into the earthen ground.

Many uses of post, as exampled by supporting fencing, provide for restriction of movement along a linear alignment of the supporting structure. The accompanying structure attached to a sequence of posts act to prevent movement of each individual post away from and/or toward adjacent posts. Therefore, in these uses, there are directions of horizontal movement which rely upon the post anchor to a lesser extent to prevent movement of the upper post than other directions of horizontal movement.

1a. Ground engaging fins

The ground engaging fins have several functions with the primary function being to provide the post anchor with resistance properties to lateral displacement within the earthen ground. Each ground engaging fin relies upon two features to resist this pressure. The first feature is exposing a surface area to the earthen ground. The second feature resides within a cooperation with adjacent intersecting ground engaging fins to trap and compress earthen ground between the intersecting ground engaging fins. In usage, several ground engaging fins will resist movement simultaneously regardless of the direction of the application of pressure.

Numerous configurations of ground engaging fins are possible. Preferably, distribution of the ground engaging fins is symmetrical on opposing hemispheres of the driveable member. While the preferred number of ground engaging fins is four, other numbers of ground engaging fins are possible.

Preferably, when the sub-grade surface is employed, the ground engaging fins attach, using their upper extents, to the lower surface of the sub-grade surface. It is also possible to have ground engaging fins extending above the sub-grade surface, or even have them penetrating the sub-grade surface, to continue upward.

Figure 3:
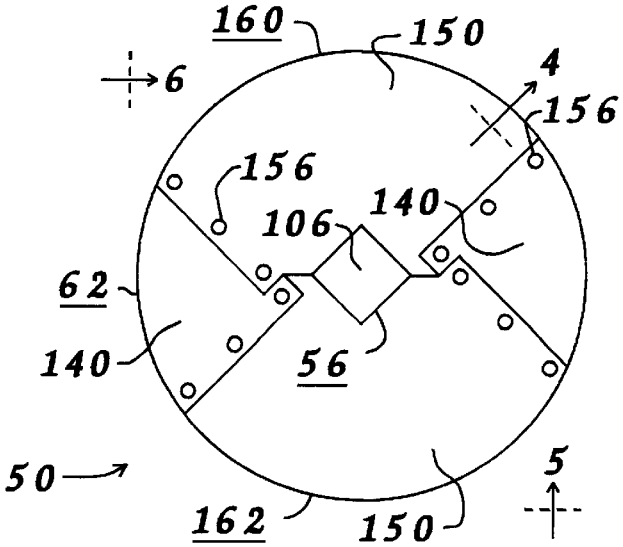
FIG. 3 is a top plan view of a driveable member formed by two, (2), of the components shown in FIG. 2.
Figure 4:
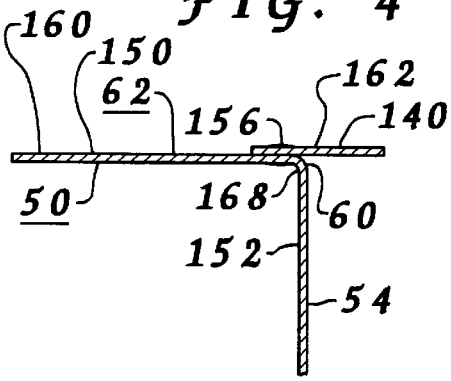
FIG. 4 is an enlarged sectional view as taken from the section line '4' shown in FIG. 3.
Figure 5:
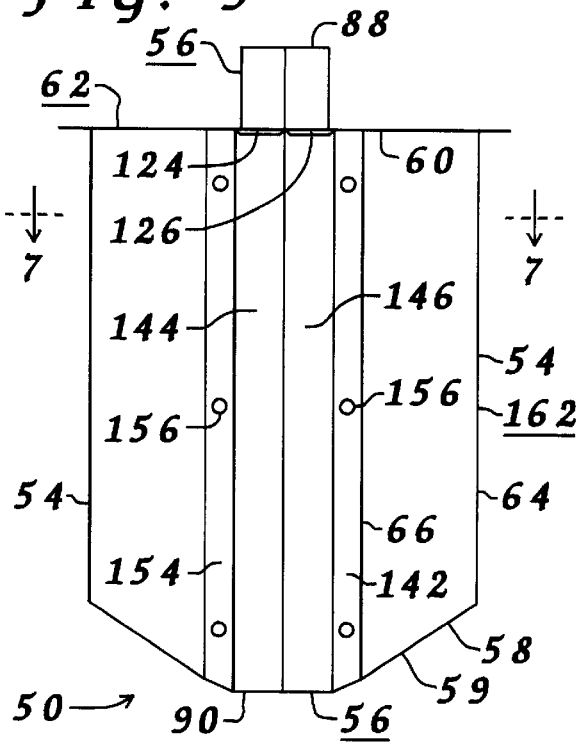
FIG. 5 is an elevational view of the driveable member as taken from the section line '5' shown in FIG. 3.
Figure 6:
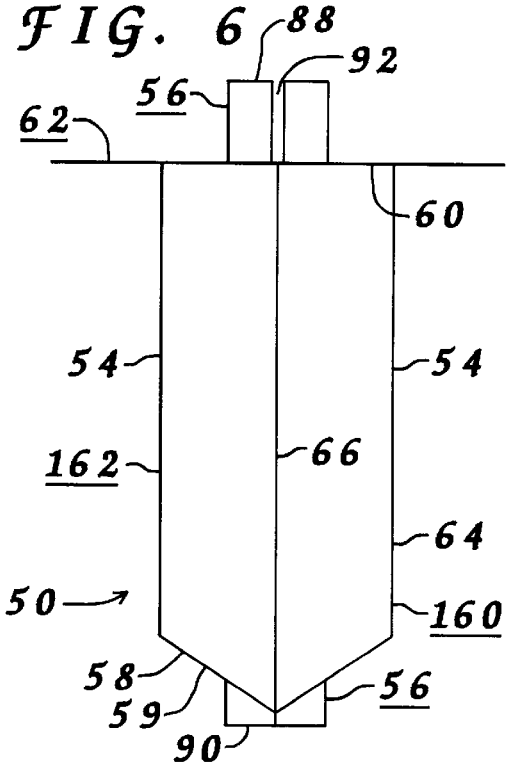
FIG. 6 is an elevational view of the driveable member as taken from the section line '6' shown in FIG. 3.
Figure 8:
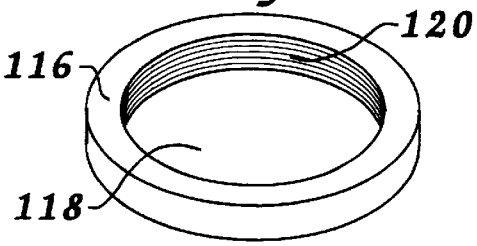
FIG. 8 is an enlarged perspective view of a locking ring.
Figure 7:
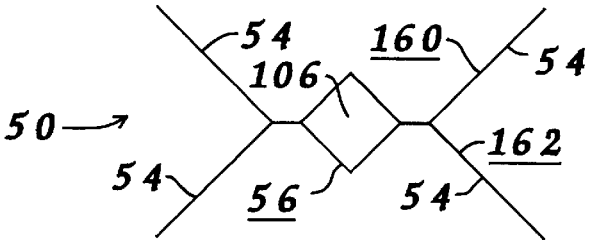
FIG. 7 is a sectional view as taken from the section lines '7' shown in FIG. 5.

Referring now specifically to FIG. 3 through FIG. 7, a driveable member 50 is depicted. Two, (2), pieces of a sheet material 52, shown in FIG. 1, cooperate to from driveable member 50. Driveable member 50 has a plurality of ground engaging fins 54 which are distributed about a post engaging channel 56. Each ground engaging fin 54, as shown in FIG. 5 and FIG. 6, has a lower edge 58. Each lower edge has an angular offset 59. As an enhancement to insertion, angular offset 59 of lower edge 58 preferably is angled upward, as depicted in FIG. 5 and FIG. 6, while extending away from post engaging channel 56. Each ground engaging fin 54 has an upper edge 60, as shown in FIG. 4, which may attach to a sub-grade surface 62, when sub-grade surface 62 is deployed. Each ground engaging fin 54 has an outer edge 64 which is preferably parallel to an inner edge 66, as shown in FIG. 5 and FIG. 6. As shown in FIG. 7, the cross section profile of driveable member 50 is such that ready insertion into earthen ground may occur with minimal earthen ground displacement.

Figure 12:
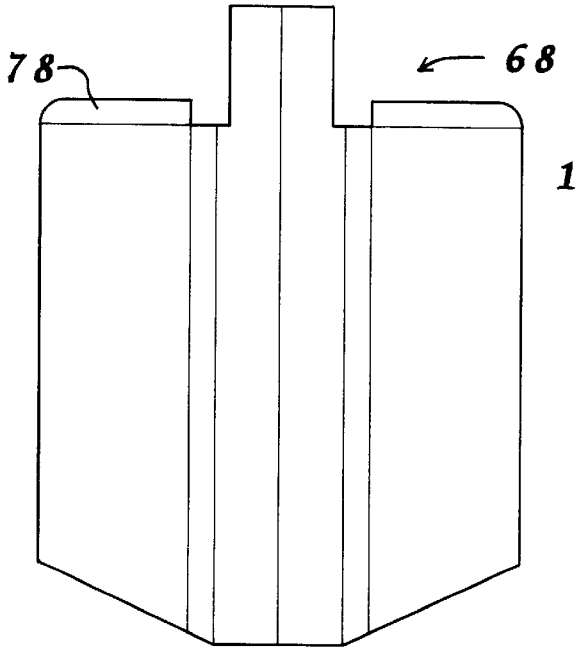
FIG. 12 is an elevational view of another embodiment of a sheet material piece.
Figure 17:
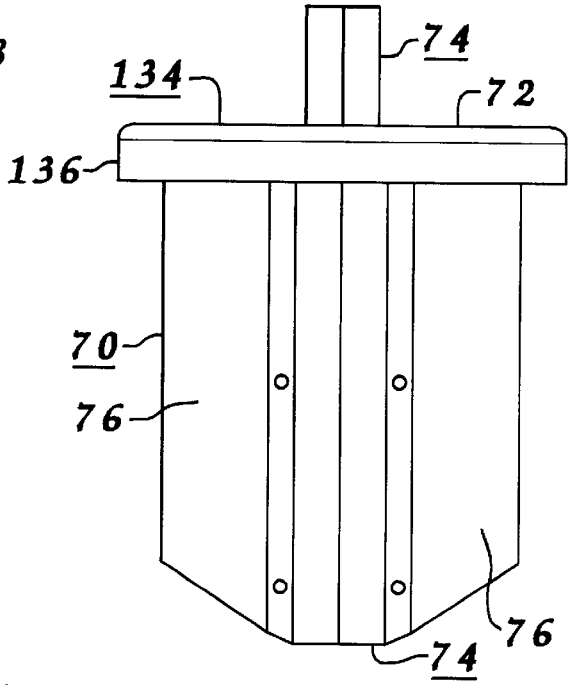
FIG. 17 is an elevational view of a driveable member formed from two, (2), of the sheet material pieces shown in FIG. 12 with the sub-grade surface shown in FIG. 14 through FIG. 16 installed thereon.

As depicted in FIG. 12 a sheet material 68 may be configured which, when utilized in a matching pair, form a driveable member 70, shown in FIG. 17, which does not have the sub-grade feature incorporated therein. FIG. 17 depicts the addition of an optional sub-grade surface 72 being a separate component as discussed below. Driveable member 70 has a post engaging channel 74 and a plurality of ground engaging fins 76.

FIG. 12 depicts tabs 78 which are bent downward to a ninety (90) degree angle to the created ground engaging fins 76, see FIG. 17. Following positioning of sub-grade surface 72 on driveable member 70 tabs 78 are in contact with an inner surface 80, see FIG. 16, of sub-grade surface 72. At that time tack welds may be employed to secured tabs 78 to inner surface 80.

Figure 24:
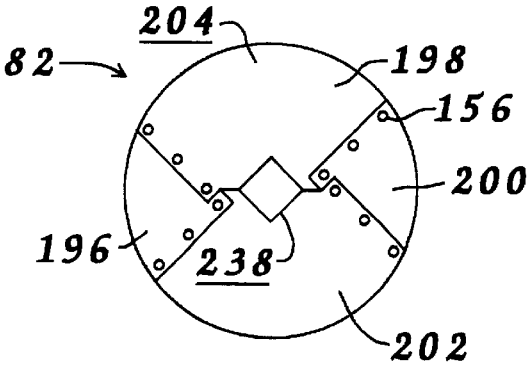
FIG. 24 is a top plan view of a driveable member formed by the sheet material piece shown in FIG. 23.
Figure 25:
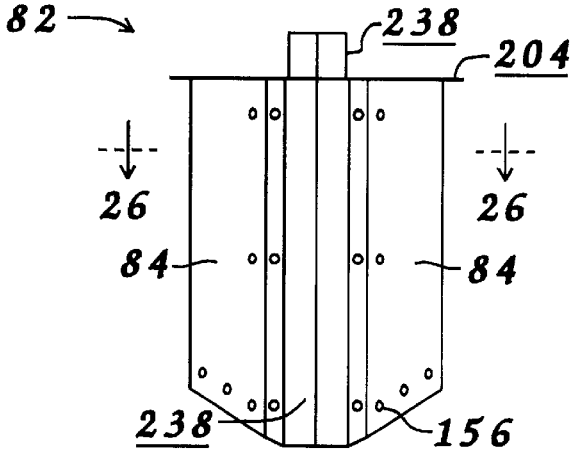
FIG. 25 is an elevational view of the driveable member shown in FIG. 24.
Figure 26:
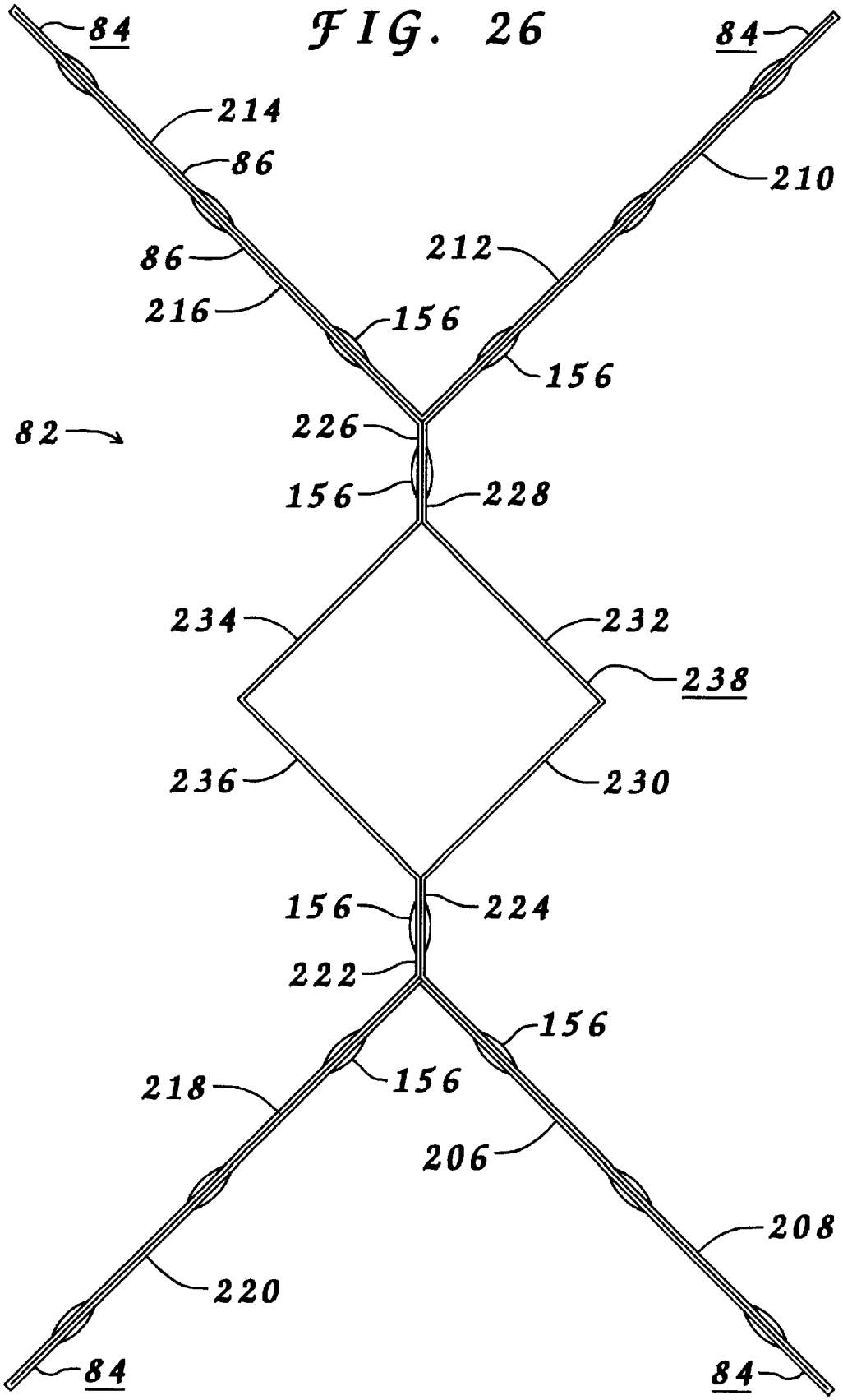
FIG. 26 is an enlarged sectional view as taken from the section lines '26' shown in FIG. 25.
Figure 31:
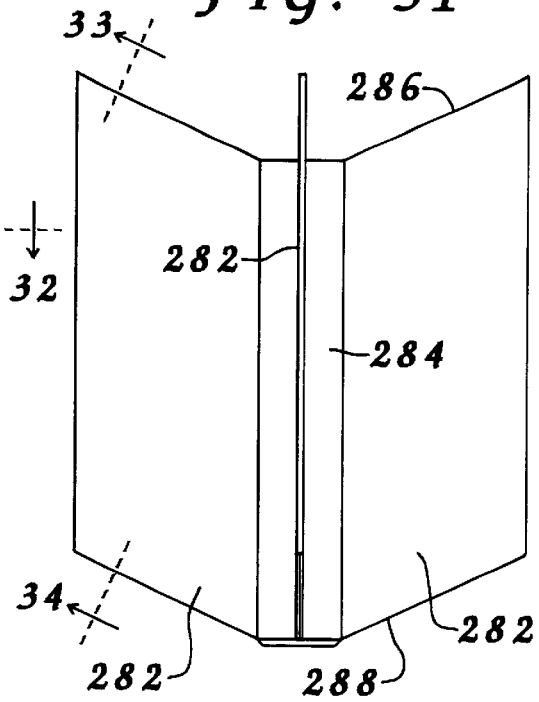
FIG. 31 is an elevational view of another embodiment of an anchor extension.
Figure 32:
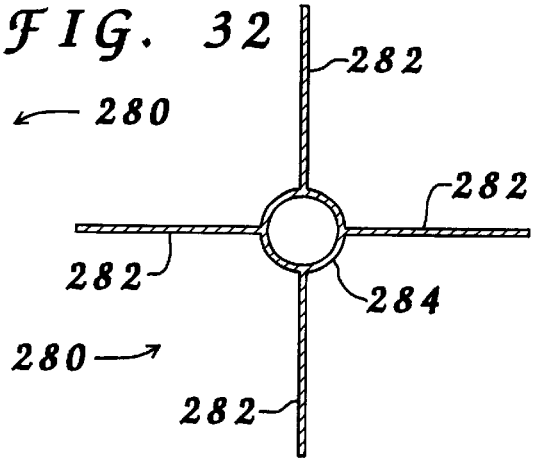
FIG. 32 is a sectional view as taken from the section line '32' shown in FIG. 31.

As depicted in FIG. 23 through FIG. 26 it is possible to provide a driveable member 82 having a plurality of ground engaging fins 84 wherein each ground engaging fin 84 has two, (2), layers of a sheet material 86, as clearly shown in FIG. 26. This provides for a reinforcement of driveable member 82 to enhance the structural integrity thereof.

1b. Post engaging channel

The post engaging channel has the primary function of contacting, and restricting, the post to the driveable member. When the sub-grade surface is present, the post engaging channel must penetrate the sub-grade surface. This provides access above the sub-grade surface to lock the driveable member to the post following installation. Several possibilities exist for placement of the ground engaging fins relative to the post engaging channel. The ground engaging fins may attach directly to the post engaging channel. The ground engaging fins may attach in directly using an intermediate member. The ground engaging fins may form the post engaging channel. It is generally desired, although not required, to provide for at least one compression slot within the post engaging channel. Such a compression slot would be located at the upper extent of the post engaging channel and extend along the post engaging channel a predetermined distance sufficient to permit compression deforming of the post engaging channel to contact the post contained therein. Ideally, two compression slots are positioned on radially opposing sides of the post engaging channel.

Referring now specifically to FIG. 3 through FIG. 11 post engaging channel 56 has a first end 88 and a second end 90. Situated on first end 88 on opposing sides are two, (2), compression slots 92, see FIG. 6 and FIG. 10. A securing collar 94, shown in FIG. 9 through FIG. 11, similarly has opposing compression slots 96, see FIG. 10, as well as a plurality of raised sections 98. Compression slots 96 of securing collar 94 begin at an upper extent 100 and extend along securing collar 94. Compression slots 96 of securing collar 94 are of a sufficient length and width to permit, when installed and aligned, a deforming of compression slots 92 of post engaging channel 56. This allows post engaging channel 56 to engage a post 102, shown in FIG. 9 through FIG. 11, to securely engage post 102. Extending along securing collar 94 are raised sections 98 each having an engaging lip 104. Each successive engaging lip 104 has a slightly greater diametric measurement than the prior engaging lip 104.

Post engaging channel 56 has an open passage 106, shown in FIG. 3 and FIG. 7, extending from first end 88 to a second end 90, shown in FIG. 5 and FIG. 6. Open passage 106 is of a slightly greater diametric size than the outside diametric size of the intended post size.

As depicted in FIG. 18 through FIG. 22 it is possible to rely upon a stamping process to form a driveable member 108 wherein curved surfaces, two, (2), panels 110, are incorporated into the final post anchor, a post engaging channel 112 in this example. This provides for a truer anchoring of posts, not shown in these views, having a round shape within post engaging channel 112. Alternatively, an insert, not shown, having curved inner surfaces, may be inserted into those post engaging channels having a configuration other than round.

1c. Locking member

Numerous methods may be employed to anchor the post to the driveable member. The art is rich with methods to anchor a first member to a second member where the first member slidably penetrates the second member. Any of these conventionally known methods may be employed to anchor the post within the post engaging channel.

Post locking means will provide for a securing of the driveable member to the post. A particularly expedient method is to have deforming compression of the post engaging channel. This deforming compression provides for friction bonding between the post engaging channel and the post.

One example of post locking means is a locking member which acts to secure the post within the post engaging channel to prevent movement of the post relative to the driveable member. This method permits ready release, adjustment of the elevation of the post relative to the driveable member of the post anchor, and resecurement at the new elevational position even after the passage of an extended period of time following initial installation.

The securing collar may be a separate securing collar clip which attaches to the post engaging channel. The separate securing collar clip allows application of a deforming pressure thereto. Use of a separate securing collar clip allows the driveable members of the sheet material post anchors to enjoy the readjustment and resecurement properties disclosed below. This is particularly true if the method of compressing the securing collar clip is a ring which treadedly engages the securing collar clip.

Figure 41:
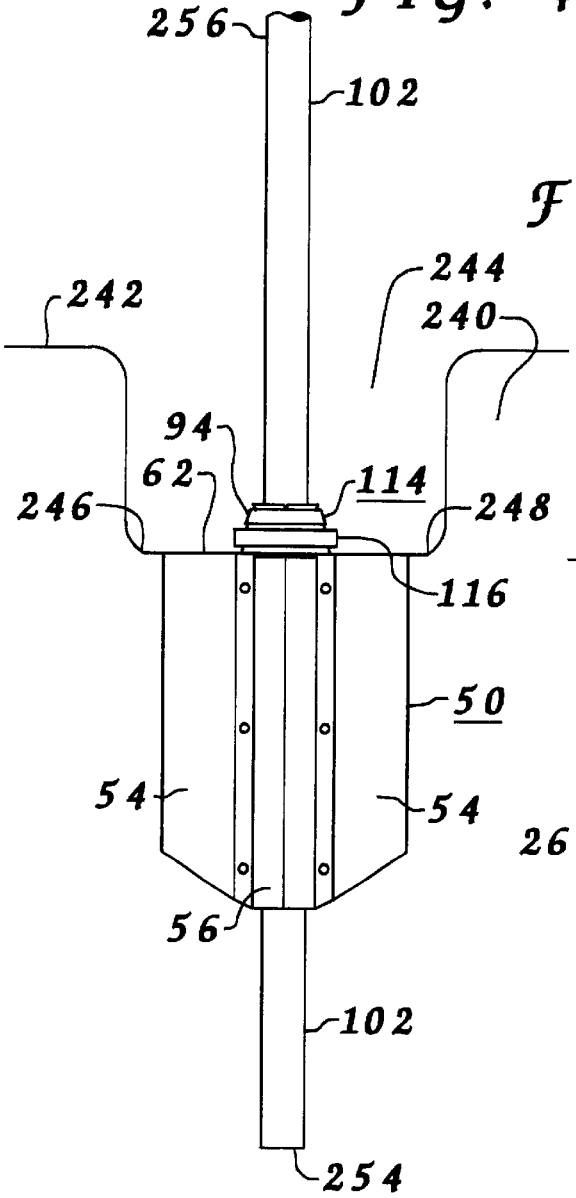

Referring now to FIG. 41, a locking member 114 comprises securing collar 94 and a ring 116. Ring 116, shown in FIG. 8, has an aperture 118 penetrating thereon with engaging ridges 120 radially disposed within aperture 118. While a plurality of engaging ridges 120 are disclosed, a single engaging feature is all that is required to facilitate locking. In use, ring 116 is placed over the post and brought into contact with securing collar 94, see FIG. 41. Ring 116 is forced downward while compression slots 96 of securing collar 94 and compression slots 92 of post engaging channel 56 deforms inward. Engaging lips 104 engage engaging ridges 120 to secure ring 116 to securing collar 94 and therefore to driveable member 50. This results in a retention of compression slots 92 and compression slots 96 in their respective deformed position.

Following installation, even following the passage of an extended period of time, locking member 114 may be cut, or otherwise manipulated, to release the securement between driveable member 50 and the post. Then, repositioning of the post elevationally and securement of the post to driveable member 50 at the new elevational position may occur. Alternatively, when a threaded compression is employed, the ring may simply be rotated to loosen where subsequent repositioning may occur. Other methods of securing the post to the driveable member may be employed without departing from the spirit of the invention.

Figure 9:
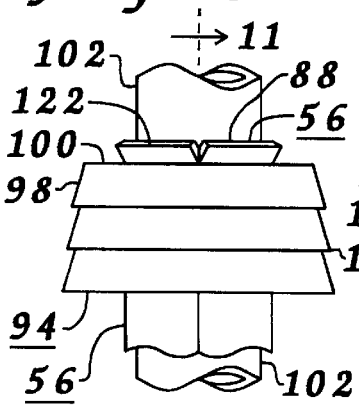
FIG. 9 is an enlarged elevational view of an insert installed on a portion of a post engaging channel with a portion of a post installed within the post engaging channel.
Figure 10:
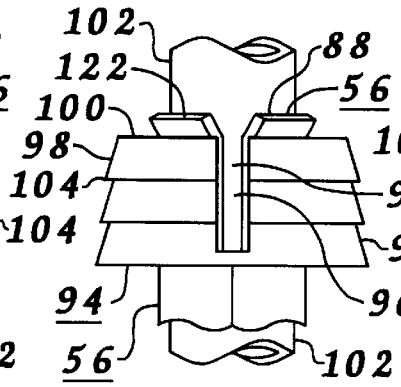
FIG. 10 is an alternative elevational view of the assembly shown in FIG. 9.
Figure 11:
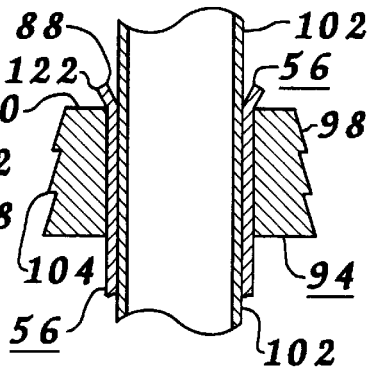
FIG. 11 is a sectional view as taken from the section line '11' shown in FIG. 9.

As depicted in FIG. 9 through FIG. 11, post engaging channel 56 may have outturns 122 at first end 88 to provide for a securement of securing collar 94 to post engaging channel 56 prior to the deforming compression. This utilization is particularly expedient when sub-grade surface 62, shown in FIG. 3 through FIG. 6, is employed.

1d. Sub-grade surface

The sub-grade surface has several functions including preventing the passage of earthen ground over the top of the ground engaging fin. Another function is to compress the earthen ground firmly beneath the driveable member. Still another function is to secure the ground engaging fins to strengthen the ground engaging fins to permit resistance to movement without yielding. Yet another function is to resist upward displacement of the post anchor which is the final movement before full removal from the earthen ground. Still another function is to provide additional weight on the driveable member from the soil compacted on top of the sub-grade surface. Another function is to provide resistance to downward settling or sinking of the driveable member into the earthen ground. Still another function is to compact soil when driven into contact with the excavated grade to pack soil around the ground engaging fins. Yet another function is to resist downward movement during the application of horizontally directed pressure to the post. This resistance prevents the post anchor, with the attached post, from moving further into the earthen ground.

The sub-grade surface may have numerous shapes including round, square, oval and rectangular depending, in part, upon the specific requirements of the intended usage. Preferably the sub-grade surface is a planar, or flat, surface. A dome shape, with or without a planar surface thereon, is possible and may provide better earthen ground containment for certain installations. Similarly, a downturn proximate the perimeter, forming a surrounding lip, enhances earthen ground displacement resistance properties.

It is also possible to have an upturned radially disposed outer edge on the sub-grade surface forming a bowl shape. Alternatively, a separate bowl member may be attached to the driveable member at the sub-grade surface, if the sub-grade surface is employed, or otherwise above the ground engaging fins. The bowl member described above provides for a cavity which provides for containment of soil which is not easily displaced from the cavity.

Referring now specifically to FIG. 3 through FIG. 7 post engaging channel 56 penetrates sub-grade surface 62. Sub-grade surface 62 has each ground engaging fin 54 secured thereto, see FIG. 4. Sub-grade surface 62 may extend to exactly cover each ground engaging fin 54, may extend beyond each ground engaging fin 54 or may extend a distance insufficient to cover each ground engaging fin 54. Variation in this coverage is possible depending upon the specific requirements of the intended usage.

As depicted in FIG. 1 and FIG. 5, it is possible to provide for opposing panels 124 and 126 to contact post engaging channel 56 for subsequent adhesion thereto using any of the methods conventionally known in the art. Such adhesion providing for enhanced structural integrity between sub-grade surface 62 and post engaging channel 56 and therefore of driveable member 50 generally.

As clearly depicted in several of the views including FIG. 1 through FIG. 6 and particularly in FIG. 4, it is possible to provide for the panels which become sub-grade surface 62 to be extensions of the panels which form ground engaging fins 54. This provides for enhanced structural integrity between sub-grade surface 62 and ground engaging fins 54 and therefore of driveable member 50 generally.

Figure 13:
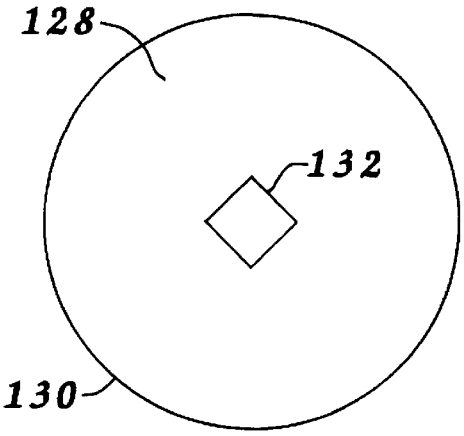
FIG. 13 is a top plan view of an embodiment of a sub-grade surface.
Figure 16:
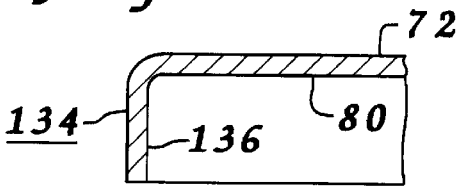
FIG. 16 is an enlarged sectional view as taken from the section line '16' shown in FIG. 14.
Figure 14:
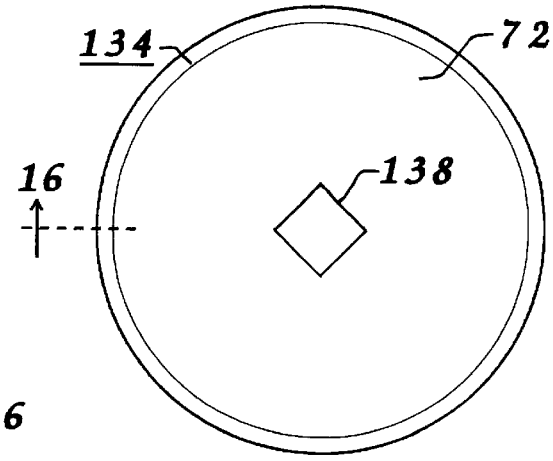
FIG. 14 is a top plan view of another embodiment of a sub-grade surface.
Figure 15:
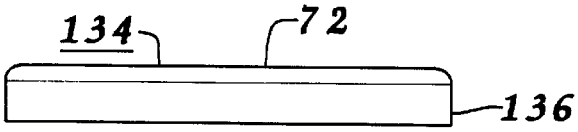
FIG. 15 is an elevational view of the sub-grade surface shown in FIG. 14.

FIG. 13 depicts that it is possible to provide for a sub-grade surface 128 which is a single plate of sheet material 130. Sub-grade surface 128 has an aperture 132 which provides for passage of the post engaging sleeve, not shown in this view, through sub-grade surface 128.

FIG. 14 through FIG. 17 depict a dome member 134 having sub-grade surface 72 having a radially surrounding lip 136 which overlaps ground engaging fins 76, see FIG. 17, when installed on driveable member 70. Dome member 134 has an aperture 138 penetrating sub-grade surface 72 which provides for passage of post engaging sleeve 74 through sub-grade surface 72.

2. Sheet Materials

A bending process permits deforming of the sheet material wherein the resultant object has a plurality of planar surfaces defined from adjacent surfaces by sharp edges. A stamping process permits deforming of sheet material wherein the resultant object may have identical features as those formed by the bending process. In addition, the stamping process permits deforming of the sheet material to render certain curved surfaces, as compared to planar surfaces, on the resultant object. As disclosed above, a linear juncture separates each pair of the resultant adjacent panels defined by either process. Formation of the sub-grade surface may be from a single panel or even a distinct single piece of sheet material.

2a. Component deforming

FIG. 1 depicts sheet material 52 deformable to form, in a matching pair, driveable member 50, shown in FIG. 3 through FIG. 7. All surfaces of driveable member 50 are planar without curvature thereof. The bolder lines of FIG. 1 indicate cut lines extending around the perimeter as well as three, (3), lines to cut not situated on the perimeter. These three, (3), cut lines not situated on the perimeter at least partially separate panel 124 from panel 126, a panel 140 from a panel 142 and a panel 144 from a panel 146. The lighter lines are linear juncture lines to indicate where bending, either by a bending process or by a stamping process, occurs to form a component 148, shown in FIG. 2. A distinct reference numeral identifies each separate panel area. The description which follows sets out and explains the angles of offset between each adjacent set of panels. Numerous other patterns exist to form driveable members having the required features of the instant invention with these examples given only to explain the principles.

A panel 150 and panel 140 cooperate to define a portion of sub-grade surface 62 shown in FIG. 3 through FIG. 6. Sub-grade surface 62 is circular and therefore panel 140 and panel 150 each have a circular shaped edge. Extending from panel 150 is panel 124 and panel 126 which both are bent upward to a ninety, (90), degree angle to panel 150. A panel 152 contacts panel 150 and forms one, (1), ground engaging fin 54. Panel 150 is bent upward to a ninety, (90), degree angle to panel 152. A panel 154 contacts panel 152 and is a contact panel with the opposing component 148. Tack welds 156 rigidly connect the pair of components 148 together along this panel, see FIG. 5. Panel 152 is bent upward to a forty-five, (45), degree angle to panel 154. Panel 144 contacts panel 154 and cooperates with other panels to define post engaging channel 56. Panel 144 partially penetrates sub-grade surface 62 following assembly. Panel 144 is bent upward to a forty-five, (45), degree angle to panel 154. Panel 146 contacts panel 144 and cooperates with panel 144 to define half of post engaging channel 56. Panel 146 partially penetrates sub-grade surface 62 following assembly. Panel 146 is bent downward to a ninety, (90), degree angle to panel 144. Panel 142 contacts panel 146 and is a contact panel with the opposing component 148. Tack welds 156 rigidly connect the pair of components 148 together along this panel, see FIG. 5. Panel 142 is bent upward to a forty-five, (45), degree angle to panel 146. A panel 158 contacts panel 142 and forms one, (1), ground engaging fin 54. Panel 158 is bent upward to a forty-five, (45), degree angle to panel 142. Panel 140 contacts panel 158 and is bent downward to a ninety, (90), degree angle to panel 158.

The various bending steps may occur simultaneously, in select groups or individually. Following the various bending steps, panel 140 and panel 150 occupy nearly the same plane, with a slight overlapping, see FIG. 2. Panel 142 and panel 154 occupy the same plane. Panel 144 and panel 158, while not occupying the same plane, have their respective planes in parallel. Panel 146 and panel 152, while not occupying the same plane, have their respective planes in parallel.

Figure 2:
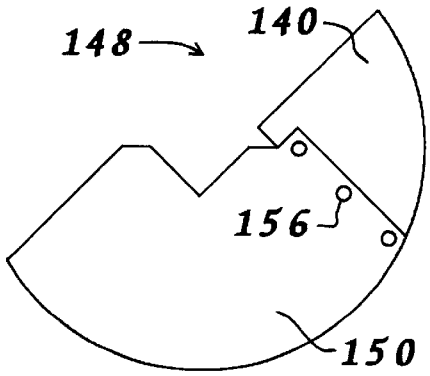
FIG. 2 is a top plan view of a component formed by the sheet material piece shown in FIG. 1.

During assembly panel 150 overlaps panel 140 and tack welds 156 are used to rigidly connect the two, (2), panels, as shown in FIG. 2. Driveable member 50 comprises a first component 160 and a second component 162, see FIG. 3 and FIG. 6. First component 160 and second component 162 are each one, (1), component 148. Each panel 140 of the two, (2), components 148 will overlap panel 150 of the other component 148. Tack welds 156 rigidly connect the two, (2), components 148 at these two, (2), overlapping locations, as shown in FIG. 3 and FIG. 4. As mentioned above, panel 142 of each component 148 will contact panel 154 of the other component 148. Tack welds 156 rigidly connecting these contact panels, as shown in FIG. 5.

Each ground engaging fin 54 extends from one, (1), of the two, (2), panels 142 or one, (1), of the two, (2), panels 154. Tack welds 156 rigidly connect each of the two, (2), sets of contacts between panel 142 and panel 154 together. Therefore, anchoring of inner edge 66, shown in FIG. 5, of each ground engaging fin 54 occurs. Upper edge 60 of each ground engaging fin 54 is a seam 168, which is an example of linear juncture, with either one, (1), panel 140 or one, (1), panel 150, see FIG. 4. Adjacent each seam 168 an overlapping of the opposing panel 140 or panel 150 occurs. Tack welds 156 rigidly connect these overlapping positions. Therefore, anchoring of upper edge 166 of each ground engaging fin 54 occurs.

Following assembly of driveable member 50, panel 124 and panel 126 contact panel 144 and panel 146 respectively directly below sub-grade surface 62, see FIG. 5. Panel 144 and panel 146 comprising one half of post engaging channel 56. Following assembly, the portions of panel 144 and panel 146 extending above sub-grade surface 62 provide for opposing compression slots 92, as shown in FIG. 6. Compression slots 92 permit compression deforming to secure driveable member 50 to post 102, shown in FIG. 9 through FIG. 11.

FIG. 4 depicts the overlapping feature associated with all connections between panels 140 and panels 150 on sub-grade surface 62. Panel 140 of second component 162 overlaps panel 150 of first component 160 and seam 168 of first component 160 common to panel 150 and panel 152. Tack welds 156 secure panel 140 and panel 150 together while providing for the structural integrity of ground engaging fin 54, in this case being panel 152.

FIG. 7 shows the cross section profile of driveable member 50 and clearly indicates that resistance to insertion into earthen ground is minimal. Displacement of earthen ground during installation similarly is minimal.

2b. Component stamping

Figure 18:
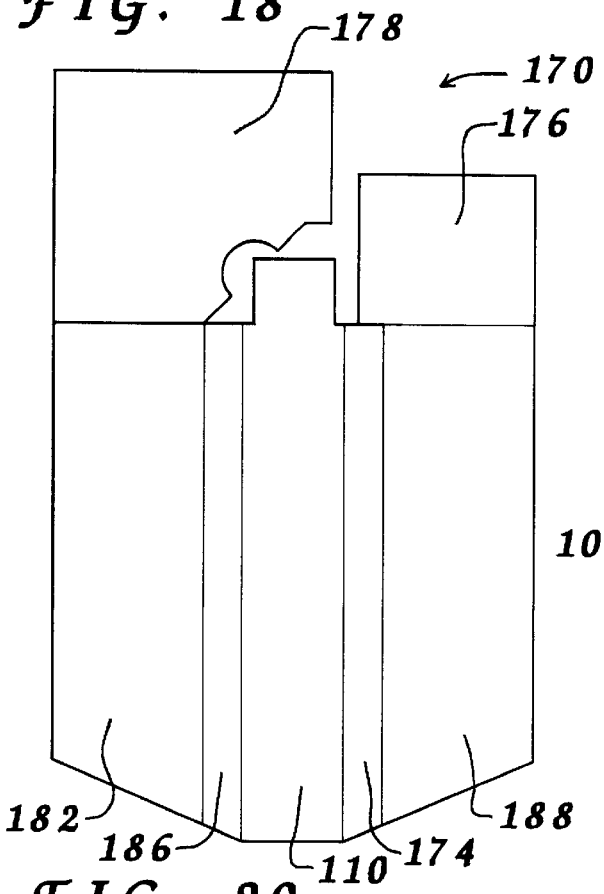
FIG. 18 is an elevational view of another embodiment of a sheet material piece.
Figure 19:
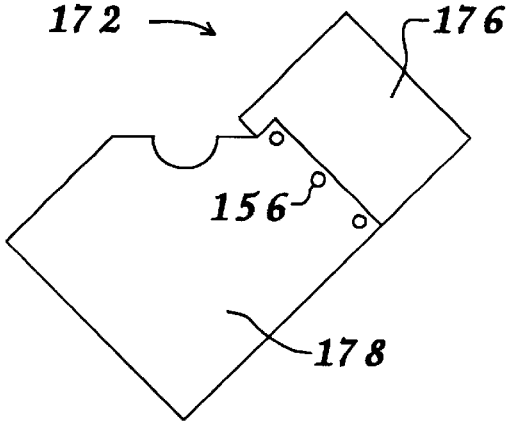
FIG. 19 is a top plan view of a component formed from the sheet material piece shown in FIG. 18.

FIG. 18 depicts a sheet material 170 capable of deforming by a stamping process to form a component 172, shown in FIG. 19. FIG. 18 shows the outline of sheet material 170, required in a matching pair, to form driveable member 108, shown in FIG. 20 through FIG. 22. Most surfaces of driveable member 108 are planar without curvature thereof while two, (2), surfaces, two, (2), panels 110, have a curvature thereon. The bolder lines in FIG. 19 indicate cut lines extending around the perimeter of sheet material 170 and one, (1), line to cut not situated on the perimeter. This one, (1), cut line separates a panel 174 from a panel 176. The lighter lines are bend lines to indicate where bending, either by a bending process or by a stamping process, occurs. This bending forms component 172, shown in FIG. 19. A distinct reference numeral identifies each separate panel area. The description which follows sets out and explains the angles of offset between each adjacent set of panels.

Panel 176 and a panel 178 cooperate to define a portion of a sub-grade surface 180. Sub-grade surface 180 is square and therefore panel 176 and panel 178 each have straight edges. A panel 182 contacts panel 178 and forms one, (1), ground engaging fin 184. Panel 178 is bent upward to a ninety, (90), degree angle to panel 182. A panel 186 contacts panel 182 and is a contact panel with the opposing member of the pair of components 172. Tack welds 156 rigidly connect the pair of components 172 together along this panel, see FIG. 20. Panel 186 is bent upward to a forty-five, (45), degree angle to panel 182. Panel 110 is deformed to have a curved shape during the stamping process. Panel 110 contacts panel 186 and cooperates with the corresponding panel, (110), on the matching component 172 to define post engaging channel 112. Panel 110 partially penetrates sub-grade surface 180 following assembly. Panel 174 contacts panel 110 and is a contact panel with the opposing member of the pair of components 172. Tack welds 156 rigidly connect the pair of components 172 together along this panel, see FIG. 20. Panel 174 and panel 186 exist on the same plane. A panel 188 contacts panel 174 and forms one, (1), ground engaging fin 184. Panel 188 is bent upward to a forty-five, (45), degree angle to panel 174. Panel 176 contacts panel 188 and is bent downward to a ninety, (90), degree angle to panel 188.

The various bending steps may occur simultaneously, in select groups or individually. Following the various bending steps, panel 176 and panel 178 occupy nearly the same plane, with a slight overlapping. Panel 174 and panel 186 occupy the same plane.

Figure 21:
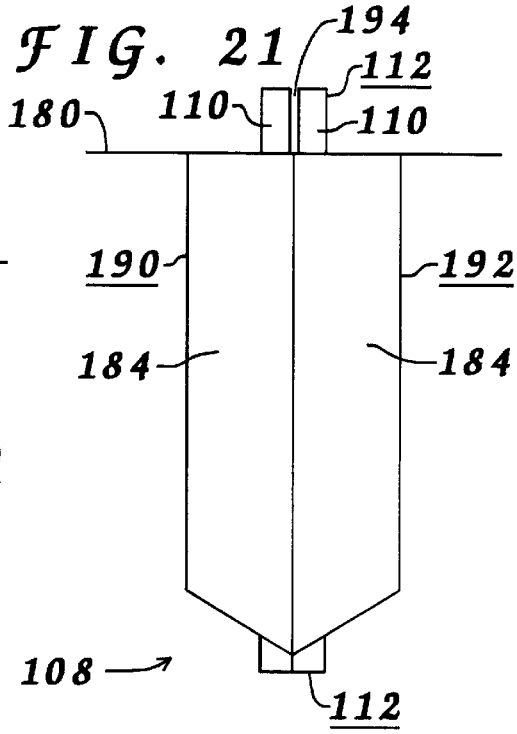
FIG. 21 is an alternative elevational view of the driveable member shown in FIG. 20.

During assembly panel 178 overlaps panel 176 and tack welds 156 are used to rigidly connect the two, (2), panels, as shown in FIG. 19. Driveable member 108 comprises a first component 190 and a second component 192. First component 190 and second component 192 are each one, (1), component 172. Each panel 176 of the two, (2), components 172 will overlap panel 178 of the other component 172. Tack welds 156 rigidly connect the two, (2), components 172 at these two, (2), overlapping locations, not shown. As mentioned above, panel 174 of each component 172 will contact panel 186 of the other component 172. Opposing compression slots 194 separate the then opposing upper extents of panels 110, as shown in FIG. 21. Compression slots 194 permit the application of contracting radial pressure to deform post engaging channel 112 to rigidly contact a post, not shown in these views, situated therein.

Figure 20:
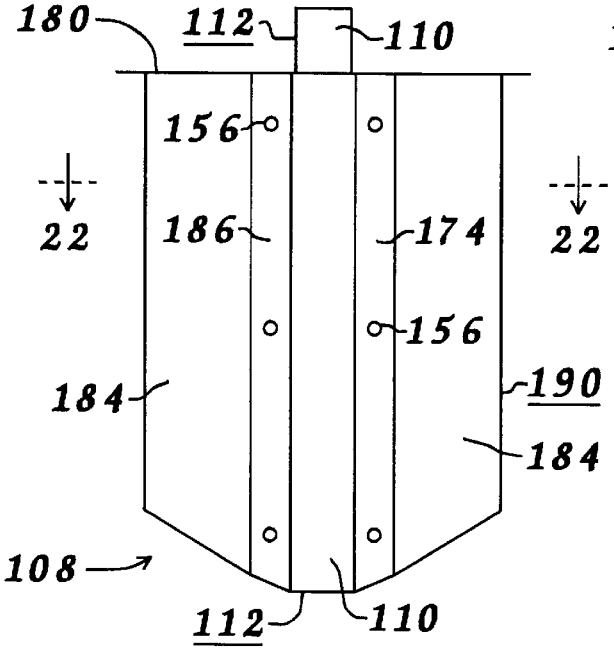
FIG. 20 is an elevational view of a driveable member formed by two, (2), of the components shown in FIG. 19.

Each ground engaging fin 184 extends from one, (1), of the two, (2), panels 174 or one, (1), of the two, (2), panels 186. Tack welds 156 rigidly connect each of the two, (2), sets of contacts between panel 174 and panel 186 together, as shown in FIG. 20. When first component 190 and second component 192 are assembled, panels 176 and panels 178 will overlap respectively and be secured thereto by tack welding, not shown.

Figure 22:
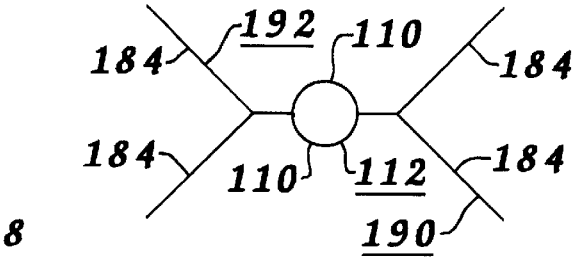
FIG. 22 is a sectional view as taken from the section lines '22' shown in FIG. 20.

FIG. 22 shows the cross section profile of driveable member 108 and clearly indicates that resistance to insertion into earthen ground is minimal. Displacement of earthen ground during installation similarly is minimal.

2c. Single piece deforming

Figure 23:
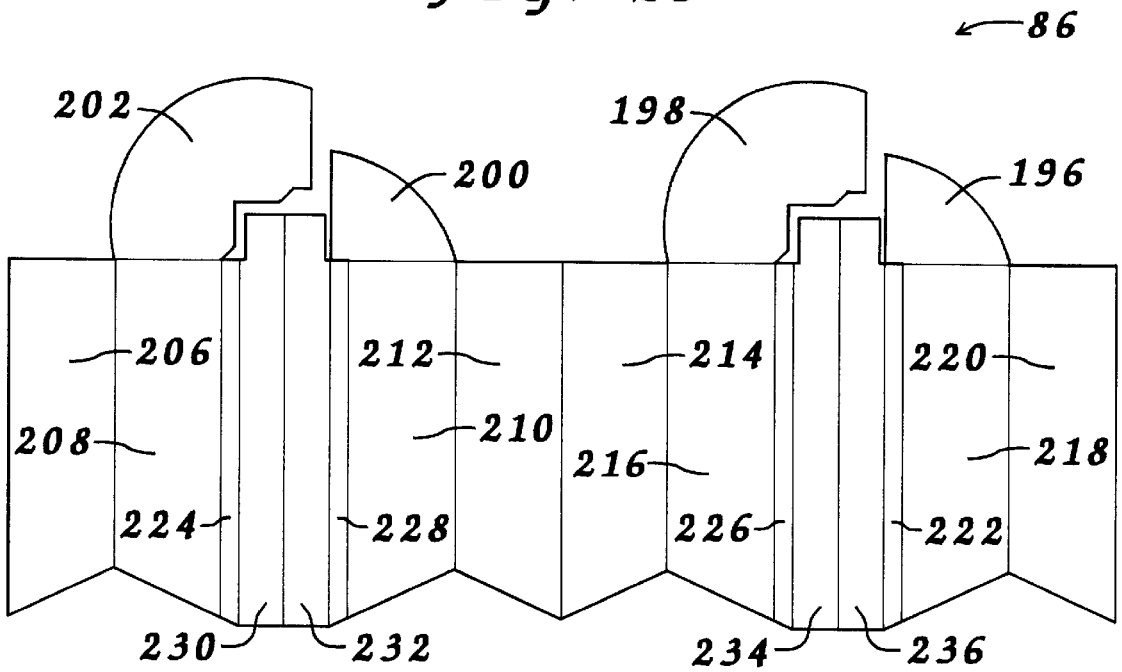
FIG. 23 is an elevational view of another embodiment of a sheet material piece.

FIG. 23 depicts sheet material 86 capable of deforming, either by a bending process or by a stamping process. Such deforming forms driveable member 82, shown in FIG. 24 through FIG. 26. Following the deforming a panel 196, a panel 198, a panel 200 and a panel 202 form a sub-grade surface 204, as shown in FIG. 24. Each of these panels 196, 198, 200 and 202 have an overlapping contact with one of the other panels 196, 198, 200 or 202. Tack welds 156 secure and reinforce these contacts, see FIG. 24. A panel 206 contacts a panel 208 and form one, (1), ground engaging fin 84. A panel 210 contacts a panel 212 and form one, (1), ground engaging fin 84. A panel 214 contacts a panel 216 and form one, (1), ground engaging fin 84. A panel 218 contacts a panel 220 and form one, (1), ground engaging fin 84. Tack welds 156 secure and reinforce these contacts, as shown in FIG. 25 and FIG. 26. A panel 222 abuts a panel 224 while a panel 226 abuts a panel 228. Tack welds 156 similarly secure and reinforce these contacts, see FIG. 26. A panel 230, a panel 232, a panel 234 and a panel 236 cooperate to form a post engaging channel 238 which extends below and above sub-grade surface 204. Additional tack welds 156, see FIG. 25, secure the lower extent of each ground engaging fin 84 to prevent separation during insertion into the earthen ground.

3. Installation Procedure

Some installed posts perform a desired function without cooperation with other installed posts. The most common example of this usage is to support a planar display surface having a message affixed thereon. Some installed posts perform their intended function in cooperation with the other installed posts in a series. The most common example of this usage is to support fencing material spanning the series and connected along the exposed vertical length of each post.

With varying degrees of accuracy, depending upon usage, a determination of a position of placement for each installation of the driveable member and the associative post occurs. Within the linear alignment for fencing support this determination must be to a relatively high degree of accuracy.

Figure 35:
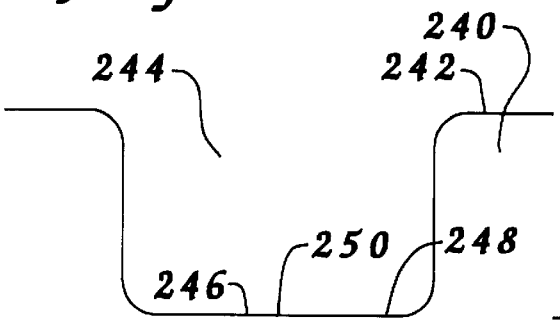
Figure 36:
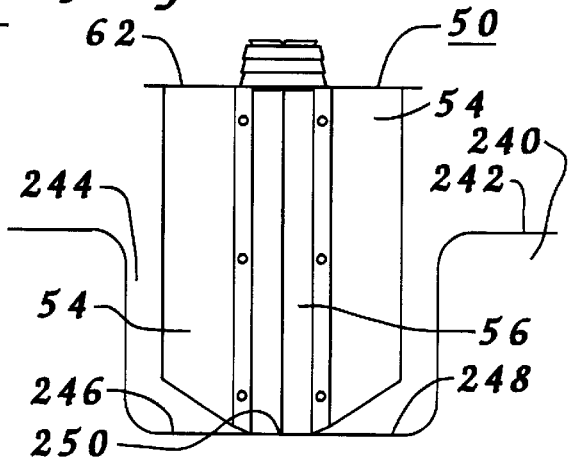
Figure 37:
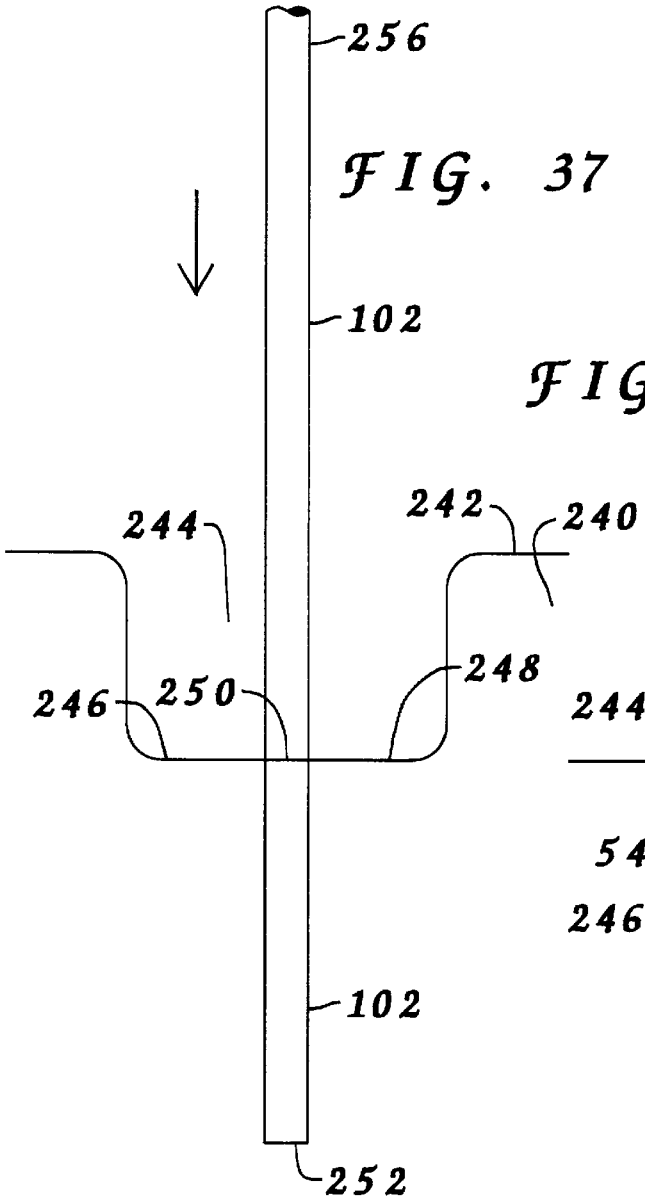

FIG. 35 through FIG. 42 depict a typical installation of driveable member 50, shown in FIG. 3 through FIG. 7, with the optional selection of either the step of FIG. 36 or the step of FIG. 37. The first step is to select the position of installation of post 102 into earthen ground 240 on a grade 242. At this position the installer digs a shallow hole to form an excavated hole 244 having a diametric measurement slightly greater than the diametric measurement of driveable member 50, as shown in FIG. 35. Excavated hole 244 has a base 246 having an excavated grade 248. When the selected driveable member has a sub-grade surface thereon, the installer will ensure that excavated grade 248 is relatively smooth. A determination of a position of post placement 250 on base 246 directly relating vertically to the original position on grade 242 then occurs, see FIG. 35.

At this point, a selection of one of two steps occurs. Using the first choice, driveable member 50 is situated in excavated hole 244 corresponding to position of post placement 250, as shown in FIG. 36. Using the second choice, which is the preferred method, driving of post 102 into base 246 of excavated hole 244 at position of post placement 250 to a first driven depth 252 occurs, as shown in FIG. 37. First driven depth 252 is a depth measured from grade 242 which is less than a final driven depth 254, shown in FIG. 40 through FIG. 42. Using this method, access must be available to an upper extent 256 of post 102 to permit a sliding installation of driveable member 50 over post 102. If an obstruction, not shown, on post 102 exists, such as a sign, then driveable member 50 is first positioned in excavated hole 244. Placement of post 102 through driveable member 50 then occurs and a driving of post 102 to first driven depth 252 occurs, as shown in FIG. 38.

Figure 42:
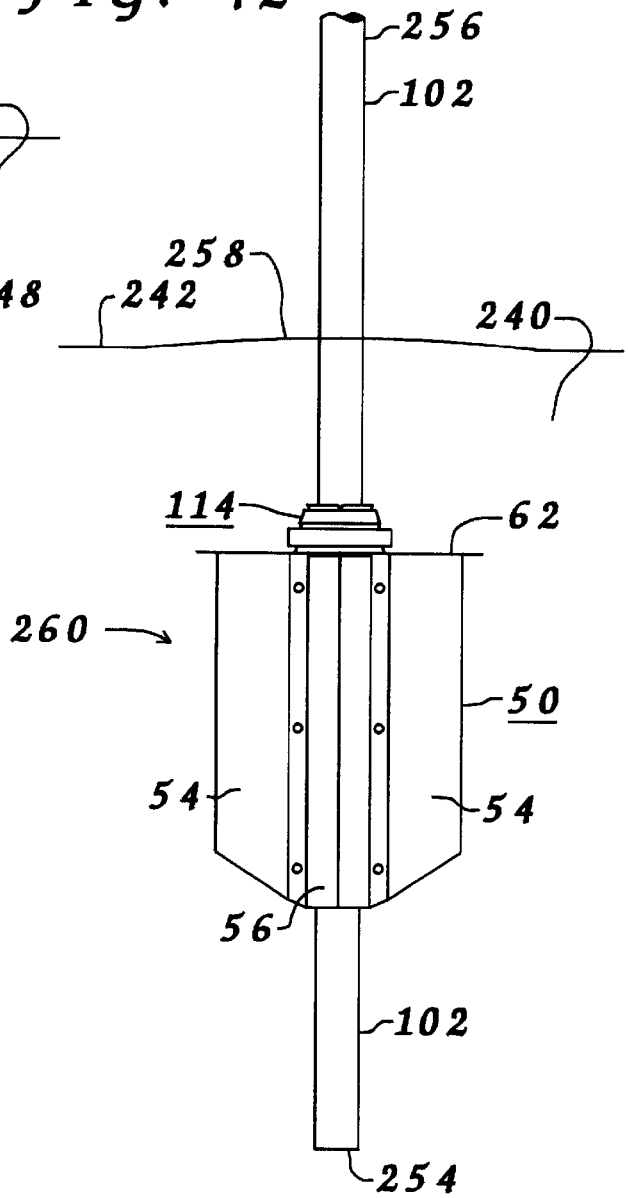

When such an obstruction exists on post 102, and the locking means being utilized must slidably mount post 102, it becomes necessary to position locking member 114, see FIG. 41 and FIG. 42, so that it is positioned for attachment to driveable member 50 following insertion of post 102 and driveable member 50 into earthen ground 240, not shown. This would be accomplished by either placing locking member 114, comprising securing collar 94 and ring 116, on driveable member 50 without deforming compression slots 92 or compression slots 96. (Compression slots 92 and 96 are not shown in these views). Alternatively, locking member 114 may be placed onto post 102 from the bottom then inserting post 102 through driveable member 50.

Figure 38:
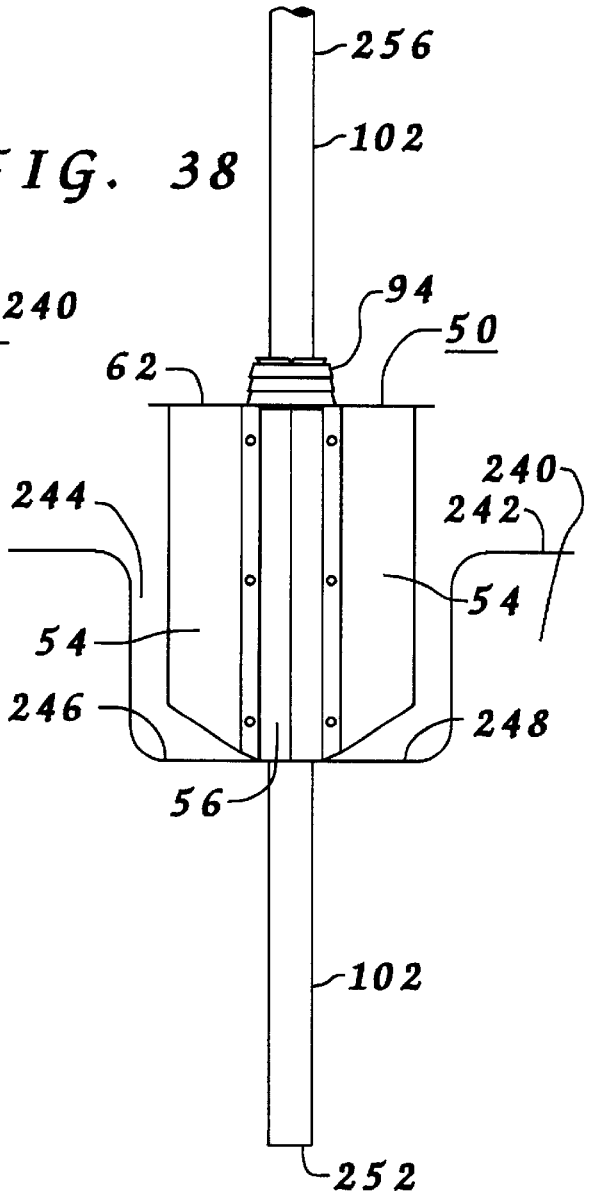

FIG. 38 represents the relative positioning of the various components regardless of the specific selection of the two previous steps. Post 102 has been driven to first driven depth 252. Driveable member 50 is slideably engaging post 102, using post engaging channel 56 with securing collar 94 attached thereto. Driveable member 50 rests on base 246 within excavated hole 244. At this point, post 102 acts as a guide to driveable member 50 when driveable member 50 is forced downward. Excavated grade 248 is of a minimum elevational distance from grade 242. This minimum distance permits securing collar 94 extending above sub-grade surface 62 to be below grade 242 when sub-grade surface 62 rests on excavated grade 248.

FIG. 39 depicts the impact insertion of driveable member 50 into earthen ground 240 while post 102 acts as a guide to ensure proper installation. Due to the cross section profile of post engaging channel 56 and ground engaging fins 54 insertion of driveable member 50 occurs with minimal displacement of earthen ground 240. A series of impact blows, with post 102 slidably guiding driveable member 50, drives driveable member 50 into earthen ground 240. Delivery of such impact blows occur until sub-grade surface 62 is firmly in contact with base 246. When sub-grade surface 62 is not deployed, delivery of such impact blows occur until the respective driveable member is inserted to a desired depth. Additional impact blows may be desirable to allow sub-grade surface 62 to further compact earthen ground 240 around ground engaging fins 54. Preferably, post 102 extends at least slightly below driveable member 50 when driveable member 50 is fully driven. This placement ensures adequate guiding properties during insertion.

FIG. 40 depicts post 102 following a final driving operation placing post 102 at final driven depth 254. Post 102 may have initially been driven to final driven depth 254. Preferably, such driving occurs following full insertion of driveable member 50.

FIG. 41 depicts placement of ring 116 on securing collar 94. Ring 116 contacts securing collar 94 to deform the compression slots, not shown in these views. This deforming of the compression slots provides for a secure friction grip. This gripping prevents vertical motion of post 102 relative to driveable member 50.

FIG. 42 depicts the final conditions following replacement of earthen ground 240 removed during forming of excavated hole 244. An earthen displacement bulge 258 remains extending slightly above grade 242 following the installation procedure. A post anchor 260, comprising driveable member 50 and locking member 114, is situated below grade 242. Ground engaging fins 54, sub-grade surface 62 and post engaging channel 56 cooperate with the section of post 102 situated below grade 242 to resist movement of post 102 above grade 242.

It may be a requirement that installation of a post occur in close proximity to an obstruction, such as a wall or a sidewalk. In this instance, removal, by cutting, of sections of ground engaging fins and sub-grade surface, if present, permits installation at the desired position of placement.

4. Anchor Extensions

Certain installation occasions may make it desirable to provide vertically oriented surfaces having a greater surface measurement than present on an available post anchor having features of the present invention. In such an occasion it is possible to deploy an anchor extension having a post engaging sleeve and a plurality of ground engaging fins. Such an extension would be deployed below a post anchor having the features of the present invention or below a post anchor having similar features as exampled by such an anchor formed by a molding process.

When such an extension is utilized it is preferred, but not required, that the ground engaging fins of the anchor extension align with the ground engaging fins of the post anchor. Numerous methods may be employed to provide for such alignment during installation. One example of such alignment means is to provide for contact members on the post anchor to engage the anchor extension. Another example is to provide for contact members on the anchor extension to engage the post anchor. Yet another example is to provide for contact members on both the post anchor and the anchor extension to engage the opposing anchor member. Still another example is to provide for an detached intermediate member or members to engage both the post anchor and the anchor extension.

FIG. 27 depicts a sheet material 262 capable of being subjected to a deforming process to form a component 264. Two, (2), components 264 are shown attached in FIG. 30 which cooperate, see FIG. 28 and FIG. 30, to form an anchor extension 266 having a plurality of ground engaging fins 268 radially disposed about a post engaging channel 270.

FIG. 27 depicts opposing series of cuts 272 in sheet material 262. FIG. 28 and FIG. 29 depict an engagement feature wherein alternating sections of sheet material 262 between cuts 272 are bent outward in opposing directions to form displaced tabs 274. Displaced tabs 274 cooperate to form a trench 276 along each ground engaging fin 268. Each ground engaging fin 268 has an angular offset 278.

Figure 43:
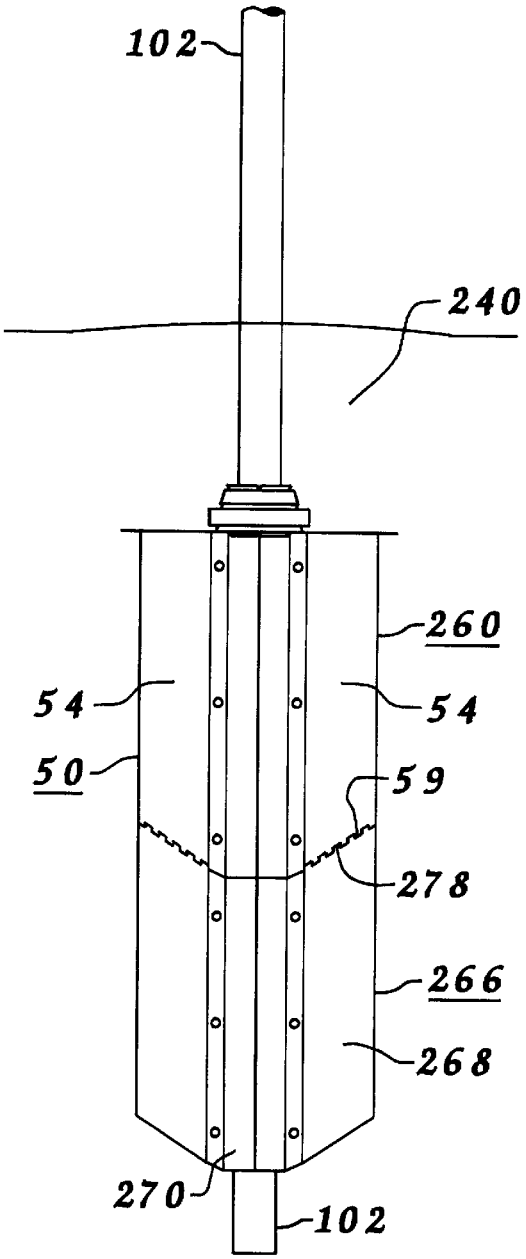
FIG. 43 is an elevational view depicting the sheet material post anchor shown in FIG. 36 and the anchor extension shown in FIG. 28 following installation.

Referring now to FIG. 43, anchor extension 266 is shown installed below post anchor 260 to anchor post 102 in earthen ground 240. Each ground engaging fin 54 of driveable member 50 of post anchor 260 has angular offset 59 which is complimentary to angular offset 278 of each ground engaging fin 268 of anchor extension 266. It is not required, nor desired, to lock anchor extension 266 to post 102. Anchor extension 266, utilizing ground engaging fins 268 and, to a lesser extent, post engaging channel 270, increases the vertically oriented surface areas which resist displacement of post 102 within earthen ground 240.

Bottoms of ground engaging fins 54 on driveable member 50 of post anchor 260 rest within trench 276, see FIG. 29, of each ground engaging fin 268 of anchor extension 266 to ensure an aligned installation into earthen ground 240.

Figure 33:
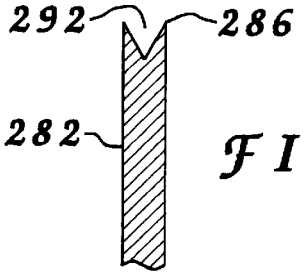
FIG. 33 is a sectional view as taken from the section line '33' shown in FIG. 31.
Figure 34:
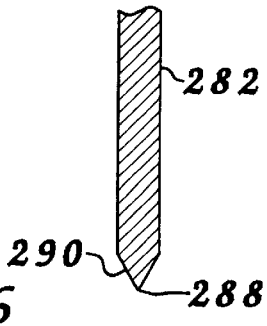
FIG. 34 is a sectional view as taken from the section line '34' shown in FIG. 31.

FIG. 31 through FIG. 34 depict an anchor extension 280 having a plurality of ground engaging fins 282 radially disposed about a post engaging channel 284. Anchor extension 280 is of a construction which may be fabricated by a molding process as conventionally known in the art. Each ground engaging fin 282 has an upper extent 286 and a lower extent 288. Lower extent 288 may have a taper 290, shown in FIG. 34. Upper extent 286 may have a recess 292, as shown in FIG. 33.

Figure 44:
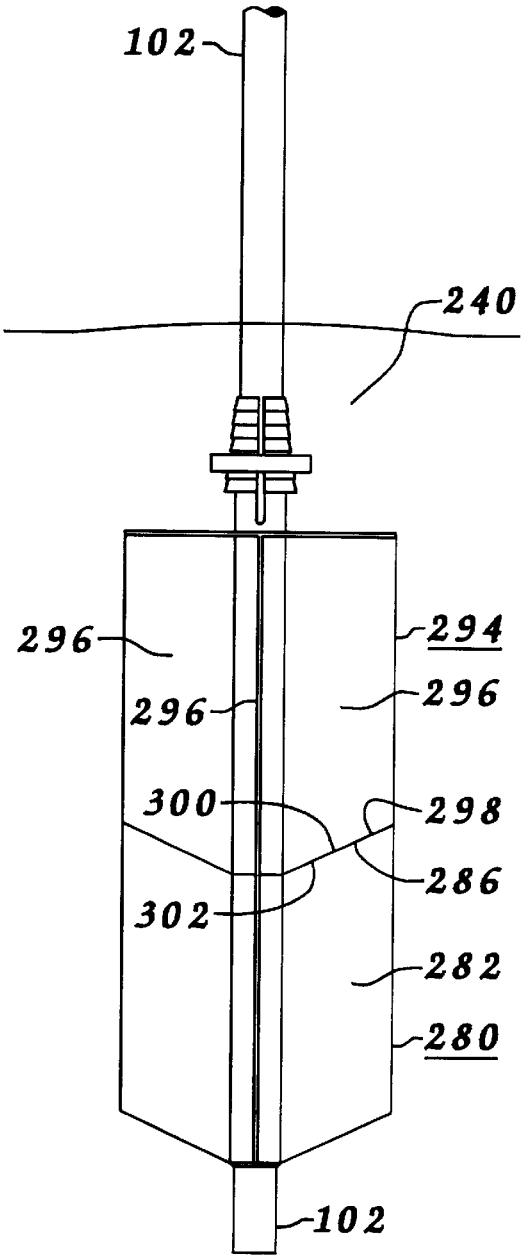
FIG. 44 is an elevational view depicting another embodiment of a post anchor and the anchor extension shown in FIG. 31 following installation.

Referring now to FIG. 44, anchor extension 280 is shown installed below a post anchor 294 to anchor post 102 in earthen ground 240. Post anchor 294 has a plurality of ground engaging fins 296 which each have a lower extent 298 which has a taper, not shown, similar to taper 290 shown in FIG. 34. Lower extent 298 of each ground engaging fin 296 of post anchor 294 has an angular offset 300. Upper extent 286 of each ground engaging fin 282 of anchor extension 280 has an angular offset 302. Angular offset 300 and angular offset 302 are complimentary. The taper of ground engaging fins 296 of post anchor 294 mates with recess 292, see FIG. 33, of each ground engaging fin 282 of anchor extension 280 to provide for an aligned installation, as depicted in FIG. 44.

5. Driveable Members without Sub-Grade Surfaces

Certain installation situations may make it desirable to deploy a post anchor which does not have a sub-grade surface attached thereto. One such installation exists where the post being supported merely retains a sign. Another such installation exists where it is not desirable to excavate a large hole at the location of insertion. In these situation it is possible to provide for insertion of a post anchor flush with or below the prevailing grade. It being recognized that it is not desirable to have the upper extents of the ground engaging fins protruding above grade for safety reasons.

One example of a completely below grade installation comprises the following steps. First the post anchor and the post are installed by driving them into the earthen ground wherein the upper extent of the ground engaging fins of the post anchor are generally flush with the prevailing grade. Then securement of the post anchor to the post occurs. Then the post anchor, with the post attached thereto, is driven to a final driven depth. Of course, it is possible to secure the post anchor to the post prior to beginning the insertion procedure.

As depicted in FIG. 46 and FIG. 48, it is possible to provide for a post anchor 304 which does not have, or otherwise rely upon, a sub-grade surface. A sheet material 306, see FIG. 45, may be so deformed as to form a component 308, two (2) of which are shown cooperating in FIG. 48 to form post anchor 304. Post anchor 304 has a post engaging channel 310 and a plurality of ground engaging fins 312.

Numerous methods may be employed to secure the post anchor to the post. As depicted in FIG. 46 and FIG. 48 apertures 314 may be positioned within post engaging channel 310 which cooperate with apertures, not shown, in post 102 to permit utilization of bolts 316 and nuts 318 therethrough to secure post anchor 304 to post 102.

Numerous configurations of cutting means may be employed at a lower extent of the respective post anchor to enhance easy insertion of the post anchor. As depicted in FIG. 45 and FIG. 47 teeth 320 may be incorporated along a lowest extent 322, see FIG. 47, of each ground engaging fin 312. Such teeth 320 have a purpose of providing a serrated edge to enhance cutting properties in the event ground engaging fin 312 encounters an obstruction, as exampled by a root not shown, during insertion of post anchor 304. Various configurations of teeth may be employed, as exampled by teeth 324 shown in FIG. 49.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sheet material post anchor to provide for securing a post vertically oriented in earthen ground, the earthen ground having a grade, the post extending above the grade following installation, the sheet material post anchor residing below the grade following installation, the sheet material post anchor having a plurality of substantially vertically oriented surfaces following installation, at least a portion of the sheet material post anchor driveable into the earthen ground during installation, the sheet material post anchor comprising:

a) a driveable member formed from at least one sheet piece, the sheet piece originating from a planar sheet material and formed by a cutting process to define a perimeter of the sheet piece and subjected to a deforming process to provide for rendering definable unique panels on the sheet piece, each panel definable from adjacent panels by a linear juncture, the driveable member comprising:

1) a plurality of ground engaging fins, each ground engaging fin to provide for resistance against the earthen ground to restrict lateral motion of the driveable member following installation of the driveable member in the earthen ground, each ground engaging fin defined by at least one of the panels and having a surface area, an upper edge and a substantially vertical orientation following installation;

2) a post engaging channel defined by at least one of the panels to provide for receiving the post;

whereby the driveable member formed from at least one of the sheet pieces, so shaped and deformed, forms the plurality of ground engaging fins and the post engaging channel, which receives the post within the post engaging channel.

2. The sheet material post anchor defined in claim 1 further comprises post locking means to provide for securing the driveable member to the post while the post is positioned within the post engaging channel at a desired elevational position relative to the driveable member for secure locking of the post by the post locking means at the desired elevational position following driven insertion of the driveable member into the earthen ground.

3. The sheet material post anchor defined in claim 2 wherein the post locking means comprises an insert and a ring member, the insert to provide for attachment to the post engaging channel and having engagement means to provide for radial compression of the post engaging channel to grip the post, the ring member to provide for the radial compression and retention of the radial compression of the insert.

4. The sheet material post anchor defined in claim 3 further comprising angulated edges at an upper extent on the unique panels forming the post engaging channel and wherein the insert cooperates with the angulated edges to secure the insert to the driveable member.

5. The sheet material post anchor defined in claim 2 further comprising a compression slot situated in the post engaging channel proximate a first end of the post engaging channel and extending longitudinally a predetermined distance along the length of the post engaging channel toward a second end; and wherein the post locking means provides for a compression of the post engaging channel proximate the compression slot to bring a portion of an inner surface of the post engaging channel into contact with a portion of an outer surface of the post.

6. The sheet material post anchor defined in claim 1 wherein the driveable member further comprises a sub-grade surface to provide for resistance against the earthen ground to restrict motion of the driveable member following installation of the driveable member in the earthen ground, the sub-grade surface defined by at least one of the panels and rigidly contacting each of the ground engaging fins and situated proximate the upper edge of the ground engaging fins, and wherein the post engaging channel penetrating the sub-grade surface of the driveable member.

7. The sheet material post anchor defined in claim 1 further comprise a second sheet piece, the second sheet piece originating from a planar material and formed by a cutting process to define the perimeter of the second sheet piece, the second sheet piece subjected to a deforming process to provide for rendering definable unique panels on the second sheet piece, each panel definable from adjacent panels by residing on differing planes, the second sheet piece rigidly secured to the sheet piece and cooperating with the sheet piece to form the driveable member.

8. The sheet material post anchor defined in claim 1 wherein each of the unique panels on the sheet piece is planar.

9. The sheet material post anchor defined in claim 1 wherein at least one of the unique panels on the sheet piece is curved.

10. A method of installing a post into earthen ground to a final driven depth, the earthen ground having a grade, the method comprising the steps of:

a) providing a sheet material post anchor comprising:

1) a driveable member formed by a cutting and bending process from at least one piece of a planar sheet material, the driveable member comprising:

a) a post engaging channel to provide for receiving the post;

b) a plurality of ground engaging fins, each ground engaging fin disposed about the post engaging channel and having a vertical orientation during and following installation of the driveable member, each ground engaging fin to provide for resistance to displacement of the driveable member through the earthen ground following installation, the plurality of ground engaging fins having a diametric measurement about the post engaging channel;

2) locking member to provide for locking a post within said post engaging channel of the driveable member at a desired elevational position relative to the driveable member;

b) then, locating a desired position of placement of the post;

c) then, excavating a hole at the desired position of placement, the hole having a diametric measurement greater than the diametric measurement of the plurality of ground engaging fins of the driveable member, the hole having a base, the base having an excavated grade;

d) then, positioning the post and the driveable member into the excavated hole with the post driven to a depth not exceeding the final driven depth;

e) then, driving the driveable member into the base of the hole while the post acts as a guide for the driveable member;

f) then, driving the post to the final driven depth;

g) then, positioning the locking member to secure the post to the driveable member;

h) then, filling the excavated hole with soil to cover the driveable member and the locking member;

whereby the position of placement of the post is located, then excavation of a shallow hole occurs at this location, then the post and the driveable member are positioned into the excavated hole with the post driven to a depth not exceeding the desired final driven depth, then the driveable member is driven into the earthen ground while the post acts as a guide, then the post is driven to the final driven depth, then the locking member is positioned to secure the post to the driveable member and then the excavated hole is filled to cover the driveable member and the locking member.

11. The method defined in claim 10 wherein the driveable member further comprises a sub-grade surface having a horizontal orientation during and following installation of the driveable member, and wherein the post engaging channel extends through the sub-grade surface and each of the ground engaging fin is securely connected to the sub-grade surface, the sub-grade surface to provide for resistance to displacement of the driveable member through the earthen ground following installation.

12. The method defined in claim 10 wherein prior to step 'd' the post is driven into the earthen ground then the driveable member is inserted over an exposed end of the post and is then slid down to contact the earthen ground.

13. The method defined in claim 10 wherein prior to step 'd' the driveable member is placed within the excavated hole and then the post is inserted through the driveable member and then driven into the earthen ground.

14. The method defined in claim 10 wherein the driveable member is formed of a single sheet piece.

15. The method defined in claim 10 wherein the driveable member further comprise a second piece, the second piece originating from the planar sheet material and formed by the cutting and bending process.

16. An assembled sheet material post anchor to provide for securing a post vertically oriented in earthen ground, the earthen ground having a grade, the post extending above the grade following installation, the sheet material post anchor residing below the grade following installation, the sheet material post anchor having a plurality of substantially vertically oriented surfaces, at least a portion of the sheet material post anchor driveable into the earthen ground during installation, the sheet material post anchor comprising:

a) two identical sheet pieces, each sheet piece originating from a planar sheet material and altered by a cutting process to define a perimeter and subjected to a deforming process to provide for rendering definable unique panels on the sheet piece, each panel definable from adjacent panels on the sheet piece, the two identical sheet pieces having an identical geometric shape following the cutting process and the deforming process, the two identical sheet pieces assembled by a rigid connection therebetween to form a driveable member, the driveable member comprising:

1) a plurality of ground engaging fins, each ground engaging fin to provide for resistance against the earthen ground to restrict lateral motion of the driveable member following installation of the driveable member in the earthen ground, each ground engaging fin defined by at least one of the panels and having a surface area, an upper edge and a substantially vertical orientation following installation;

2) a post engaging channel defined by at least one of the panels, the post engaging channel to provide for receiving the post;

b) post locking means to provide for securing the driveable member to the post while the post is positioned within the post engaging channel at a desired elevational position relative to the driveable member;

whereby the two identical sheet pieces, each shaped and deformed, cooperate to form the driveable member having the plurality of ground engaging fins and the post engaging channel, and the driveable member may receives the post within the post engaging channel for secure locking of the post by the post locking means at the desired elevational position following driven insertion of the driveable member into the earthen ground.

17. The assembled sheet material post anchor defined in claim 16 wherein the driveable member further comprises a sub-grade surface to provide for resistance against the earthen ground to restrict motion of the driveable member following installation of the driveable member in the earthen ground, and wherein the sub-grade surface is defined by at least one of the panels and is rigidly contacting each of the ground engaging fins and is situated proximate the upper edge of the ground engaging fins.

18. The assembled sheet material post anchor defined in claim 16 wherein the post locking means comprises an insert and a ring member, the insert to provide for attachment to the post engaging channel and having engagement means to provide for radial compression of the post engaging channel to grip the post, the ring member to provide for the radial compression and retention of the radial compression of the insert.

19. The assembled sheet material post anchor defined in claim 16 further comprising a compression slot situated in the post engaging channel proximate a first end of the post engaging channel and extending longitudinally a predetermined distance along the length of the post engaging channel toward a second end; and wherein the post locking means provides for a compression of the post engaging channel proximate the compression slot to bring a portion of an inner surface of the post engaging channel into contact with a portion of an outer surface of the post.

20. The assembled sheet material post anchor defined in claim 16 wherein the rigid connection between the two identical pieces comprises tack welding.

* * * * *